US007437833B2

(12) United States Patent
Sato et al.

(10) Patent No.: US 7,437,833 B2
(45) Date of Patent: Oct. 21, 2008

(54) HAND DRYER WITH TOP SURFACE OPENING AND VERTICAL SPLASH PLATES

(75) Inventors: Shingo Sato, Fukuoka (JP); Yoshihiro Yonezawa, Fukuoka (JP); Hideyasu Kai, Fukuoka (JP)

(73) Assignee: ToTo Ltd. (JP)

( * ) Notice: Subject to any disclaimer, the term of this patent is extended or adjusted under 35 U.S.C. 154(b) by 0 days.

(21) Appl. No.: 11/560,934

(22) Filed: Nov. 17, 2006

(65) Prior Publication Data

US 2007/0079524 A1 Apr. 12, 2007

Related U.S. Application Data

(63) Continuation of application No. PCT/JP2005/008423, filed on May 9, 2005.

(30) Foreign Application Priority Data

May 19, 2004 (JP) ..... 2004-149546
Jul. 13, 2004 (JP) ..... 2004-206488

(51) Int. Cl.
*F26B 19/00* (2006.01)

(52) U.S. Cl. ..... 34/90

(58) Field of Classification Search ..... 34/90, 34/103, 104, 202; 4/619
See application file for complete search history.

(56) References Cited

U.S. PATENT DOCUMENTS 3,766,397 A * 10/1973 Rockson ..... 250/432 R
5,146,695 A * 9/1992 Yang ..... 34/90
5,459,944 A * 10/1995 Tatsutani et al. ..... 34/202

FOREIGN PATENT DOCUMENTS

| | | | |
|---|---|---|---|
| JP | 61-109533 | | 5/1986 |
| JP | 63-154138 | | 6/1988 |
| JP | 05-293055 | | 9/1993 |
| JP | 06-209879 | | 2/1994 |
| JP | 6-272287 | * | 9/1994 |
| JP | 10-099235 | | 4/1998 |
| JP | 2000-000181 | | 7/2000 |

(Continued)

*Primary Examiner*—S. Gravini
(74) *Attorney, Agent, or Firm*—Brooks Kushman P.C.

(57) ABSTRACT

A hand dryer is disclosed having little unpleasant blowback from the hand insertion opening portion of the hand drying chamber and little splattering of water droplets around the device, and offering superior drying performance. The hand dryer 1 of the present invention comprises a box-shaped main housing 2 constituted by a front side wall portion 11, a rear side wall portion 13, and a bottom surface portion 14 forming a hand drying chamber 10 having a rear member 6, side members 8, and a hand insertion opening portion 12 opening on the top surface thereof; an electric blower 16 contained within the main housing; a nozzle means 18 provided on the front side wall portion and the rear side wall portion of the main housing and blowing an air flow from the electric blower toward hands inserted into the hand drying chamber; a ventilation opening portion 22 formed on the side of the main housing and ventilating the air flow in the hand drying chamber to the outside, and a water droplet splatter prevention means 24 provided on the ventilation opening portion to prevent the splattering of water droplets in the hand drying chamber to the outside.

16 Claims, 20 Drawing Sheets

FOREIGN PATENT DOCUMENTS

| | | |
|---|---|---|
| JP | 2001-104211 | 4/2001 |
| JP | 2002-034844 | 5/2002 |
| JP | 2003-250720 | 9/2003 |
| JP | 2004-305447 | 4/2004 |
| JP | 2005-027693 | 3/2005 |

* cited by examiner

HAND DRYER WITH TOP SURFACE OPENING AND VERTICAL SPLASH PLATES

CROSS-REFERENCE TO RELATED APPLICATIONS

This is a continuation of PCT international application no. PCT/JP2005/008423, published in Japanese, with an international filing date of May 9, 2005, which claims priority to JP 2004-149546, filed May 19, 2004 and JP 2004-206488, filed Jul. 13, 2004, which are hereby incorporated by reference in their entirety.

TECHNICAL FIELD

The present invention relates to a hand dryer, and more particularly to a hand dryer for drying a user's hands by blowing air thereon.

BACKGROUND ART

In recent years, hand dryers in which wet hands are inserted after washing and then dried by the automatic blowing of an air flow have been installed in railroad stations, hotels, movie theaters, large commercial facilities, and the like. Such conventional hand dryers are attached to the wall in restrooms or around washbasins, when wet hands are inserted into a hand drying chamber through an opening provided on the top surface, an internal electric blower automatically turns on and blows an air flow into the drying chamber, and that air flow causes water adhering to the hands to be dried as the blowing proceeds (See Patent Documents 1-4).

Patent Document 1: JP-B-3094687
Patent Document 2: JP-B-3148435
Patent Document 3: JP-A-2002-34844
Patent Document 4: JP-A-2001-104211

DISCLOSURE OF THE INVENTION

Problems the Invention is to Solve

In the hand dryers disclosed in Patent Documents 1 and 2, not only the top, but also both the left and right sides are left open, thus affording a superior sense of freedom, as well as the additional ability to insert wet hands from the left or right side. However, such a structure has the problem that when a user is drying his or her wet hands in the drying chamber, drops of water blown off the hands by the air stream can splatter out of the open portions on the left and right sides, dirtying the area around the device.

In the hand dryer disclosed in Patent Document 3, there is no direct splattering of water drops blown off hands inserted into the drying chamber from the side, since only the top surface of the drying chamber is open. However, because air blown from the electric blower into the drying chamber in a hand dryer of such a structure circulates within the drying chamber and is then blown outward from the upper opening thereby in some cases causing discomfort when this blowing hits the face or body, or ruffling of clothes or the like. When the blowback is accompanied by water droplets blown off the hands, water droplets may also splatter around the device. Reducing the volume of air flow blown into the drying chamber in order to suppress such blowback leads to the different problem of reduced drying performance.

The hand dryer disclosed in Patent Document 4 is the same as that set forth in Patent Document 3 with respect to being opened only at the top of the drying chamber, but because the air intake opening for the electric blower is disposed inside the drying chamber, a portion of the air flow blown into the drying chamber is suctioned into this air intake opening, resulting in a reduction in the above-described blowback, and suppression of water droplet splattering.

In the device disclosed in Patent Document 4, however, air suctioned from the air intake opening is accompanied by moisture blown off the hands, resulting in a new problem, which is that of penetration by this moisture into the electric blower or other air flow paths, leading to degradation of the blower or other problems.

In the hand dryer disclosed in Patent Documents 1 and 2, wet hands are inserted into the hand drying chamber, and water droplets blown off these wet hands flow into a water drain opening provided at the rear and bottom of the hand drying chamber, after which they drips into a hose connected to the drain opening and are returned to a drain tank disposed at the bottom of the device.

In the hand dryer disclosed in Patent Document 3, water droplets blown of wet hands are suctioned into the suction opening together with the air flow, borne by the air flow in the recovery portion flow path of the circulation path and accelerated downward; they are then separated by falling under their own inertia down to the position of a water droplet recovery opening at a curved position on the way to a reflow portion, then recovered in a drain tank.

In the hand dryer disclosed in Patent Document 4, water droplets splattered from wet hands are suctioned into a suction opening along with the air flow, impacting upon the lower wall due to inertia and passing through a drain hole and drain pipe to be expelled to outside of the device body.

However, problems arose in the interior of the circulation path connected to the drain opening in the hand dryers disclosed in Patent Documents 1 and 2, or in the interior of the circulation path connected to the drain opening in the hand dryers disclosed in Patent Documents 3 and 4, such as the dirtying of drain water adhering to the respective interiors thereof, or bad odors generated by bacteria proliferating within that dirty water. Try as one might to clean such areas, it is difficult to do so, since the drain hose structure and circulation pathways are disposed within the hand dryer.

In order to recover drain water, the bottom portion at the rear side of the hand insertion area in the hand dryer disclosed in Patent Document 2 is a surface inclined toward drain openings formed on both edges, and standing portions are formed on both edge portions of the bottom surface, therefore cleaning of dirt accumulated in the border portion between the bottom and the standing portion must be wiped out at the some effort, and some dirt is left behind.

The present invention, therefore, was undertaken to resolve the above-described technical issues, and has an object of providing a hand dryer with superior drying performance and little unpleasant blowback from the hand drying chamber hand input opening, and little splattering of water droplets in the vicinity of the device.

The present invention has a further object of providing a hand dryer in which there is little unpleasant blowback from the hand drying chamber hand insertion opening and little splattering of water droplets around the device, and in which the bottom portion of the hand drying chamber, where dirt is a concern, can be easily cleaned.

Means for Solving the Problems

In order to achieve the above object, the present invention provides a hand dryer for drying a user's hands by blowing air thereon, the hand dryer comprising a box-shaped main housing including a front member, a back member, side members, and a hand drying chamber with a hand insertion opening portion opening on the top surface thereof, the hand drying chamber being formed by a front side wall portion, a rear side wall portion, and a bottom portion; an electric blower contained within the main housing; a nozzle device disposed on the front side wall portion and the rear side wall portion of the hand drying chamber for blowing an air flow carried from the electric blower toward hands inserted into the hand drying chamber; a ventilation opening portion, formed in the side of the main housing, for ventilating the air flow within the hand drying chamber; and a water droplet splatter prevention device disposed on the ventilation opening portion for preventing the splattering to the outside of water droplets in the hand drying chamber.

According to the hand dryer of the present invention mentioned above, the user can, by inserting his or her hands from the hand insertion opening portion into the hand drying chamber, dry his or her hands using the air flow blown out from the nozzle device toward the hand drying chamber. Because an air flow blown into the hand drying chamber from the nozzle device is exhausted to the outside from ventilation opening portions formed on the side of the main housing, blowback at the hand insertion opening portion is reduced. Moreover, because the device for preventing water droplet splatter is provided in the ventilation opening portion, splattering of water droplets in the vicinity of the device is also reduced, thereby achieving superior drying performance.

In the present invention, preferably, the ventilation opening portion and water droplet splatter prevention device are formed on the side member of the main housing.

In the present invention, preferably, the ventilation opening portion and the water droplet prevention device are formed in a side cover, which is removably attached to the side member of the main housing. Moreover, a ventilation interior opening portion is formed in a position corresponding to the ventilation opening portion on the side member.

In the present invention, preferably, the water droplet splatter prevention device is a plurality of plate-shaped members arrayed at predetermined intervals on the ventilation opening portion so as to form a rising slope from the inside toward the outside of the ventilation opening portion.

According to the present invention mentioned above, the water droplets blown from wet hands during hand drying impact either one of the plate-shaped members so that the water droplet splatter to the outside can be prevented and the air flow only can be exhausted through the opening portions of the plate-shaped members. The air flow blown from the nozzle device into the hand drying chamber hits the hands inserted in the hand drying chamber and drops down, then contacts the bottom portion of the hand drying chamber and splits into a leftward flow and a rightward flow, after which the both flows contact the respective left and right side members or the respective left and right side covers and become rising flows. Since the rising slope from the inside toward the outside of the ventilation opening portion is formed, the rising flows are induced upward along the slope of each of the plate-shaped members and smoothly exhausted outward. As a result, the air flow can be more quickly exhausted to the outside, and drying performance is further enhanced.

In the present invention, preferably, the water droplet splatter prevention device is provided with a rib formed on at least the upper edge portion of the ventilation opening portion so as to protrude into hand drying chamber.

According to the present invention mentioned above, the rib functions as an overhang. Because water droplets from wet hands which are blown about during hand drying and adhere to the left and right side surfaces of the hand drying chamber pass over the top surface of the rib and flow downward so as to avoid the ventilation opening portion, the rib can prevent the direct passage of water droplets through the ventilation opening portion and the resulting splattering to the outside. The provision of the rib can also increase strength around the ventilation opening portion upper edge portion.

In the present invention, preferably, the plate-shaped members are arrayed so as to form a downward slope toward the front side or the rear side of the hand dryer.

According to the present invention mentioned above water droplets blown from wet hands flow down along the downward slope of the plate-shaped members after impacting thereupon, thus permitting efficient recovery of water droplets in a fixed location.

In the present invention, preferably, the rib is positioned at a downward slope toward either the front surface side or the rear surface side of the hand dryer.

According to the present invention mentioned above, after water droplets blown from wet hands impact the rib, they flow downward along the downward slope thereof, thus permitting efficient recovery of the water droplets in one location.

In the present invention, preferably, the ventilation opening portion is formed in a part of the side member positioned near to and above the bottom portion of the hand drying chamber.

According to the present invention mentioned above, an air flow blown from the nozzle device into the hand drying chamber hits hands inserted in the hand drying chamber and drops down, then contacts the bottom portion of the hand drying chamber and splits into a leftward flow and a rightward flow, after which the both flows contact the respective left and right side members and become rising flows. The rising flows are quickly exhausted to the outside from the ventilation opening portions formed in parts of the respective side members near to and above the bottom portion of the hand drying chamber. As a result, the present invention permits even faster exhausting of the air flow to the outside, and drying performance is further enhanced. Not only can blowback from the upper surface hand insertion opening portion be reliably suppressed, but splattering of water droplets from the top surface hand insertion opening portion can also be reduced.

In the present invention, preferably, the ventilation opening portion is formed in a part of a side cover positioned near to and above the bottom portion of the hand drying chamber.

According to the present invention mentioned above, an air flow blown from the nozzle device into the hand drying chamber hits hands inserted in the hand drying chamber and drops down, then contacts the bottom portion of the hand drying chamber and splits into and a left and right flow, after which it contacts the side members on the respective sides and becomes a rising flow, but this rising flow is quickly exhausted to the outside from a part of the side member positioned near to and above the bottom portion of the hand drying chamber. Therefore the present invention permits even faster exhausting of air flows to the outside, and further enhances drying performance. Not only can blowback from the upper surface hand insertion opening portion be reliably suppressed, but splattering of water droplets from the top surface hand insertion opening portion can also be reduced.

In the present invention, preferably, the ventilation opening portion is formed to have essentially the same shape as the sectional shape viewed from the side of the hand drying chamber.

According to the present invention mentioned above, air flow within the hand drying chamber can be quickly exhausted to the outside, making it effective for improving drying performance.

In the present invention, preferably, a downward curving arc-shaped portion is formed on the top edge portion of the side member of the main housing.

According to the present invention, the upper opening on the hand drying chamber appears larger than actual size when viewed from above the hand dryer due to the perspective effect, and is therefore of practical utility. An air flow blown from the nozzle device into the hand drying chamber hits hands inserted in the hand drying chamber and drops down, then contacts the bottom portion of the hand drying chamber and splits into a leftward and rightward flow, after which it contacts the respective left and right side members and becomes a rising flow. The rising flow is exhausted to the outside from ventilation opening portions formed on the side members, but a portion thereof is blown back from the hand insertion opening portion. However, according to the. present invention a downward curving arc-shaped portion is formed in the top edge portion of the side members, and the air flow blown back from the hand insertion opening portion escapes in a horizontal direction from the arc-shaped portion of the side members, therefore the air flow can be effectively exhausted to the outside, and drying performance improved.

In the present invention, preferably, a downward curving arc-shaped portion is formed in the top edge portion of the side cover.

According to the present invention mentioned above, the upper opening on the hand drying chamber appears larger than actual size when viewed from above the hand dryer due to the perspective effect, and is therefore of practical utility. The air flow blown from the nozzle device into the hand drying chamber hits hands inserted in the hand drying chamber and drops down, then contacts the bottom portion of the hand drying chamber and splits into a leftward and rightward flow, after which it contacts the respective left and right side members and becomes a rising flow. This rising flow is exhausted to the outside from the ventilation opening portions formed on the side members, but a portion thereof is blown back from the hand insertion opening portion. However, according to the present invention a downward curving arc-shaped portion is formed in the top edge portion of the side members, and the air flow blown back from the hand insertion opening portion escapes in a horizontal direction from the arc-shaped portion of the side members, therefore the air flow can be effectively exhausted to the outside, and drying performance improved.

The present invention preferably further comprises a water drain path formed on the outside surface of the main housing so as to drain water droplets downward from at least one edge side of the bottom portion of the hand drying chamber.

According to the present invention mentioned above, the drain path is formed on the outside surface of the side member of the main housing, thus enabling exposure of the drain path to the outside. As a result, the drain path can be easily cleaned.

The present invention preferably further comprises a drain path formed by the side member outside surface and a side cover inside surface of the main housing so as to drain water droplets downward from at least one edge side of the bottom portion of the hand drying chamber. Here, the side cover is such that it can be removably attached to the main housing side member.

According to the present invention mentioned above, the side cover conceals water droplet drips or drip traces in the drain path, thereby producing a favorable outward appearance. Also, because there is no possiblity of water droplets splattering from the drain path, the environment surrounding the installation can be kept clean. During cleaning, it is sufficient to separate the side cover from the main housing; the drain path and the side cover can be easily cleaned, and cleanability and maintainability are improved.

The present invention preferably further comprises a front cover removably attached to the main housing front member, and a drain path formed from the outside surface of the main housing front member and the inside surface of the above-described front cover so as to drain water droplets inside the hand drying chamber downward from the front edge side of the bottom portion of the hand drying chamber.

According to the present invention mentioned above, the front cover conceals water droplet drips or drip traces in the drain path, thereby producing a favorable outward appearance. Also, because there is no possibility of water droplets splattering from the drain path, the environment surrounding the installation can be kept clean. During cleaning, it is sufficient to separate the front cover from the main housing; the drain path and the front cover can be easily cleaned, and cleanability and maintainability are improved. Moreover, because of the disposition of a drain path on the front member side, cleaning of the drain path can be accomplished from the front, thus facilitating the cleaning operation.

In the present invention, preferably, the bottom portion of the hand drying chamber has an inclined surface formed at a downward slope from the center thereof toward both edges.

According to the present invention mentioned above, water droplets falling to the bottom portion of the hand drying chamber flow down under gravity along the inclined surface, and are furthermore blown along by the air flow flowing along the bottom portion toward the two edges so as to be quickly induced to the two side edges of the hand drying chamber, thereby improving water draining performance.

In the present invention, preferably, the bottom portion of the hand drying chamber has an inclined surface formed at a downward slope from one edge thereof toward the other edge thereof.

According to the present invention mentioned above, water droplets falling to the bottom portion of the hand drying chamber flow downward under gravity from one edge to the other along the inclined surface and, moreover, are blown back by air flow which flowing along the inclined surface from one edge to the other edge, thus improving water draining performance.

The present invention preferably further comprises a water receiving portion, provided at the bottom end of said water drain path, for recovering water droplets flowing down the water drain path, and the bottom end of the water drain path is formed so as to protrude into said main housing at a gentle inclination with respect thereto.

According to the present invention mentioned above, leakage of moisture around the hand dryer can be prevented because water droplets which have flowed downward through the drain path can be reliably recovered in a water receiving portion disposed at the bottom end of the drain path. The ability to reduce the size of the water receiving portion is also an advantage from a design standpoint.

The present invention also provides a hand dryer for drying a user's hands by blowing air thereon, the hand dryer comprising a main housing forming a hand drying chamber with a hand insertion opening portion which opens in a part thereof; an electric blower contained within the main housing; a nozzle device disposed on the main housing, blowing an air flow carried from the electric blower toward hands inserted into the hand drying chamber; a ventilation opening portion, formed in a part other than that in which the hand insertion opening portion of the hand drying chamber of the main housing opens, for ventilating the air flow within the hand drying chamber to the outside; and a water droplet splatter prevention device disposed on the ventilation opening portion for preventing the splattering to the outside of water droplets in the hand drying chamber.

According to the present invention mentioned above, the user can dry his or her hands by inserting them from the hand insertion opening portion into the hand drying chamber. Since the air flow blown into the hand drying chamber from the nozzle means is exhausted to the outside from a ventilation opening portion formed on the side of the main housing, blowback at the hand insertion opening portion is reduced. Furthermore, because a water droplet splatter prevention means is disposed on this ventilation opening portion, splattering of water droplets around the device is also reduced, and superior drying performance can be achieved.

Effects of the Present Invention

According to the hand dryer of the present invention, there is little uncomfortable blowback from the hand insertion opening portion of the hand drying chamber, and little splattering of water droplets around the device; therefore superior drying performance can be achieved. Also, the drain path, which can be a source of bad odors, and the bottom portion of the hand drying chamber, where dirt is a concern, are made more easily cleanable.

BEST MODE FOR CARRYING OUT THE INVENTION

Figure 1:
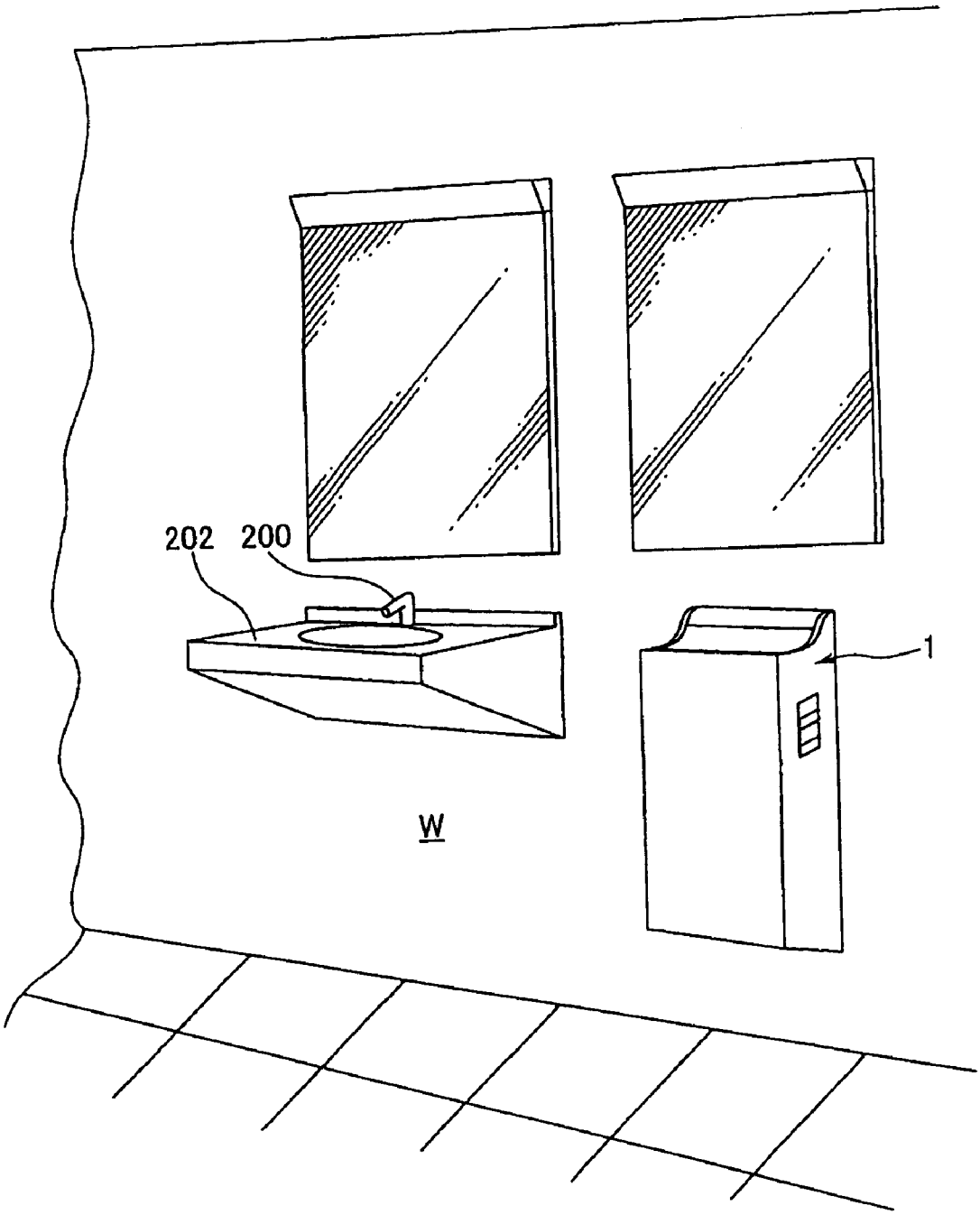
FIG. 1 is a perspective view showing a hand dryer according to a first embodiment of the present invention installed in a washroom.

Below, based on the attached figures, we will explain embodiments of the hand dryer of the present invention. FIG. 1 is a perspective view showing a hand dryer according to a first embodiment of the present invention installed in a washroom.

As depicted in FIG. 1, the hand dryer 1 of the embodiment is, for example, installed next to a faucet 200 and a wash basin 202. Persons who have washed their hands using the faucet 200 and the wash basin 202 use the hand dryer to dry their wet hands.

Note that in addition to the form of installation shown in FIG. 1, various other installation forms may be adopted for the hand dryer 1, such as installation on walls other than those adjacent to a wash basin, or close to a wash basin installed in a counter or the like.

Figure 2:
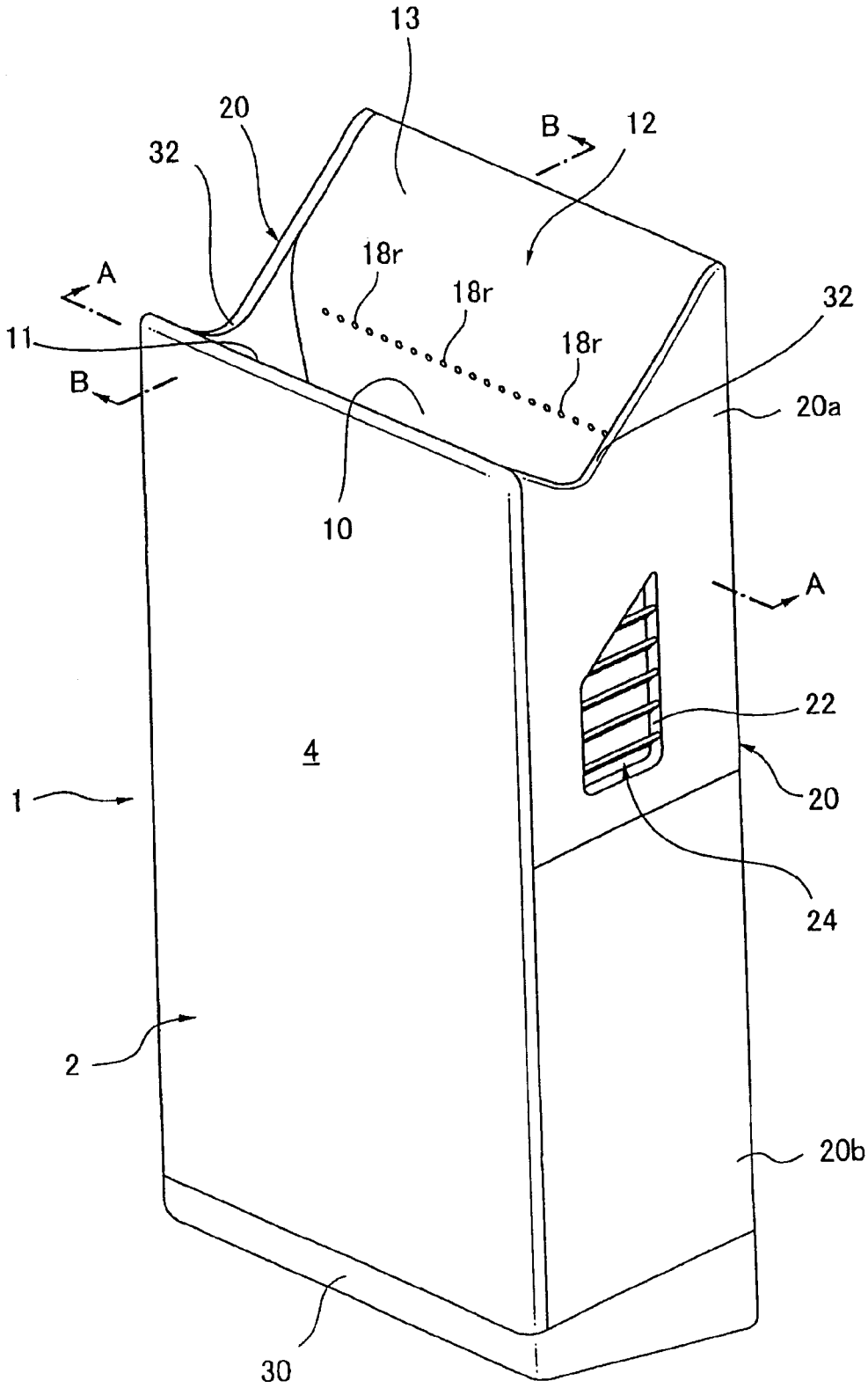
FIG. 2 is a perspective view showing the hand dryer of the first embodiment of the present invention.
Figure 3:
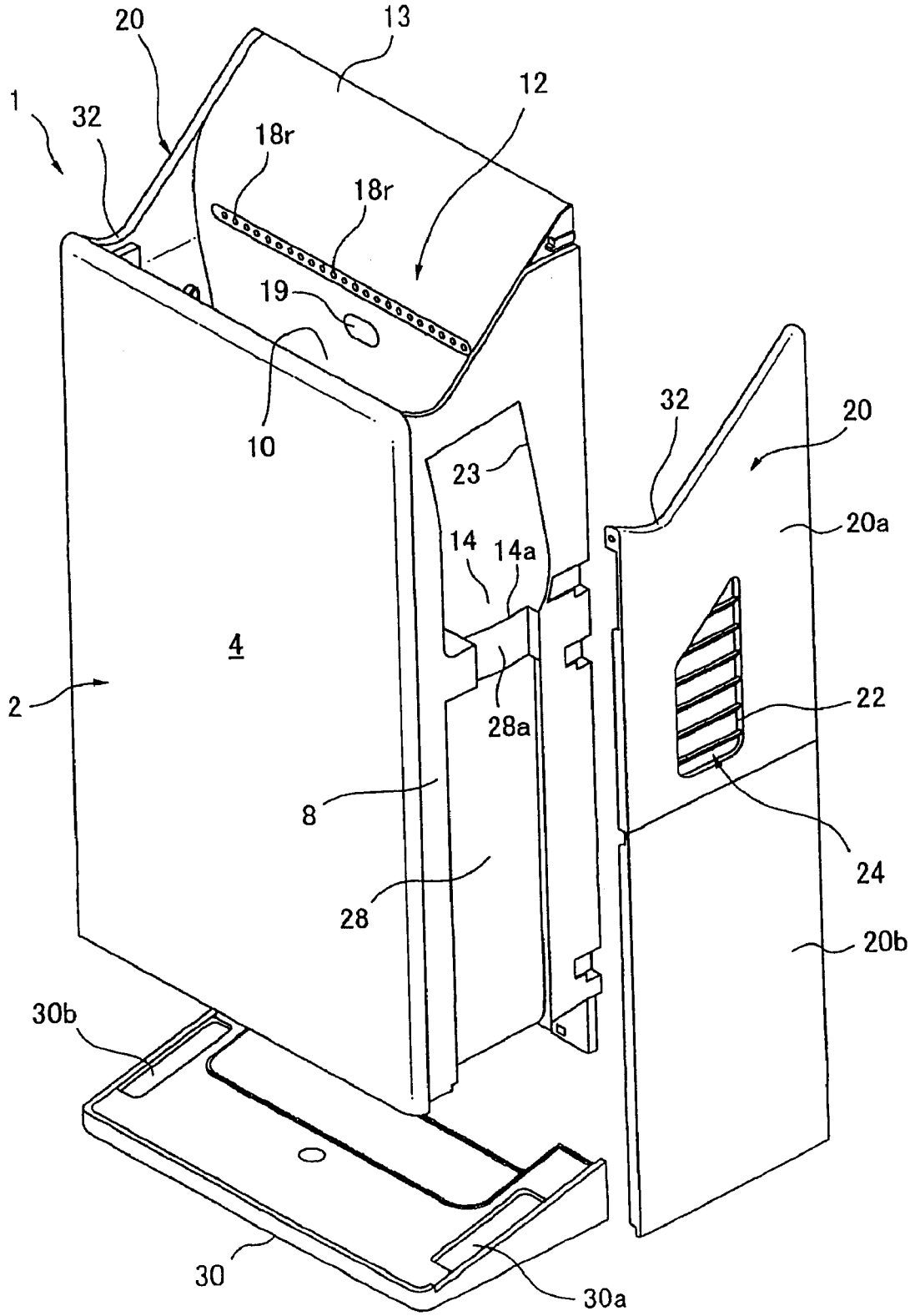
FIG. 3 is a exploded perspective view of the hand dryer of the first embodiment.
Figure 4:
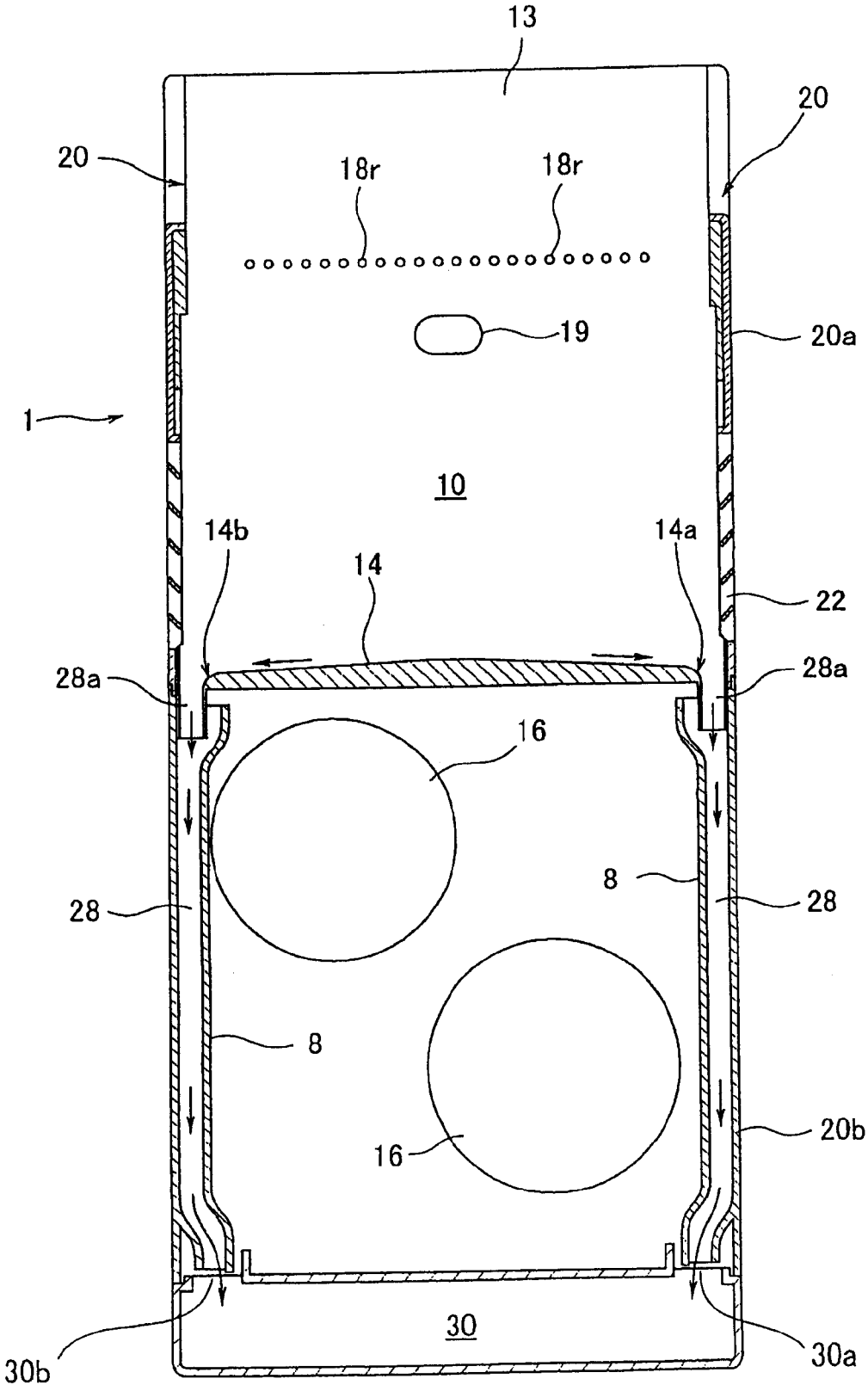
FIG. 4 is a sectional view along line A-A in FIG. 4.
Figure 5:
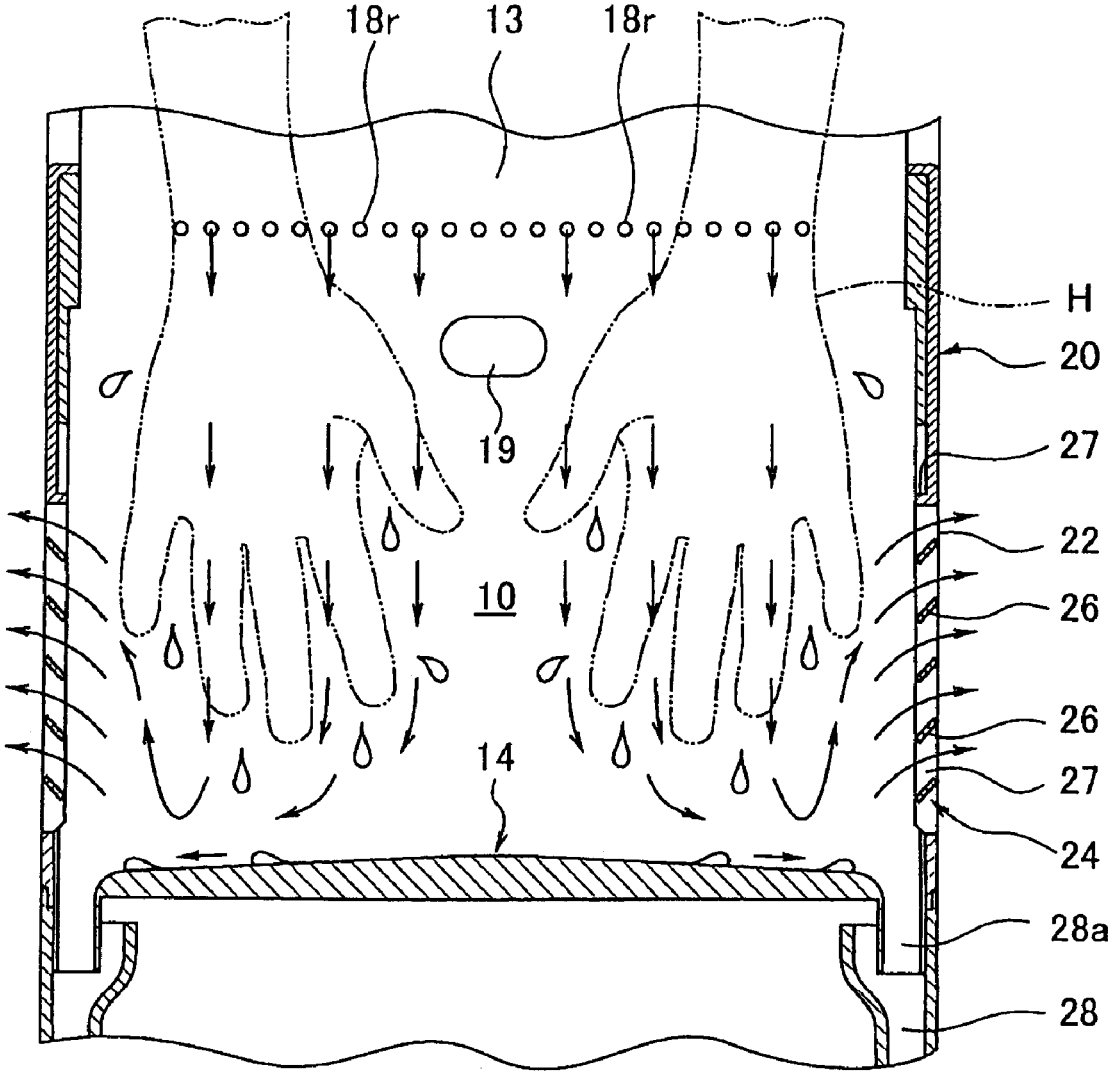
FIG. 5 is a partial expanded section as seen along line A-A in FIG. 2 showing the state in which hands are inserted.
Figure 6:
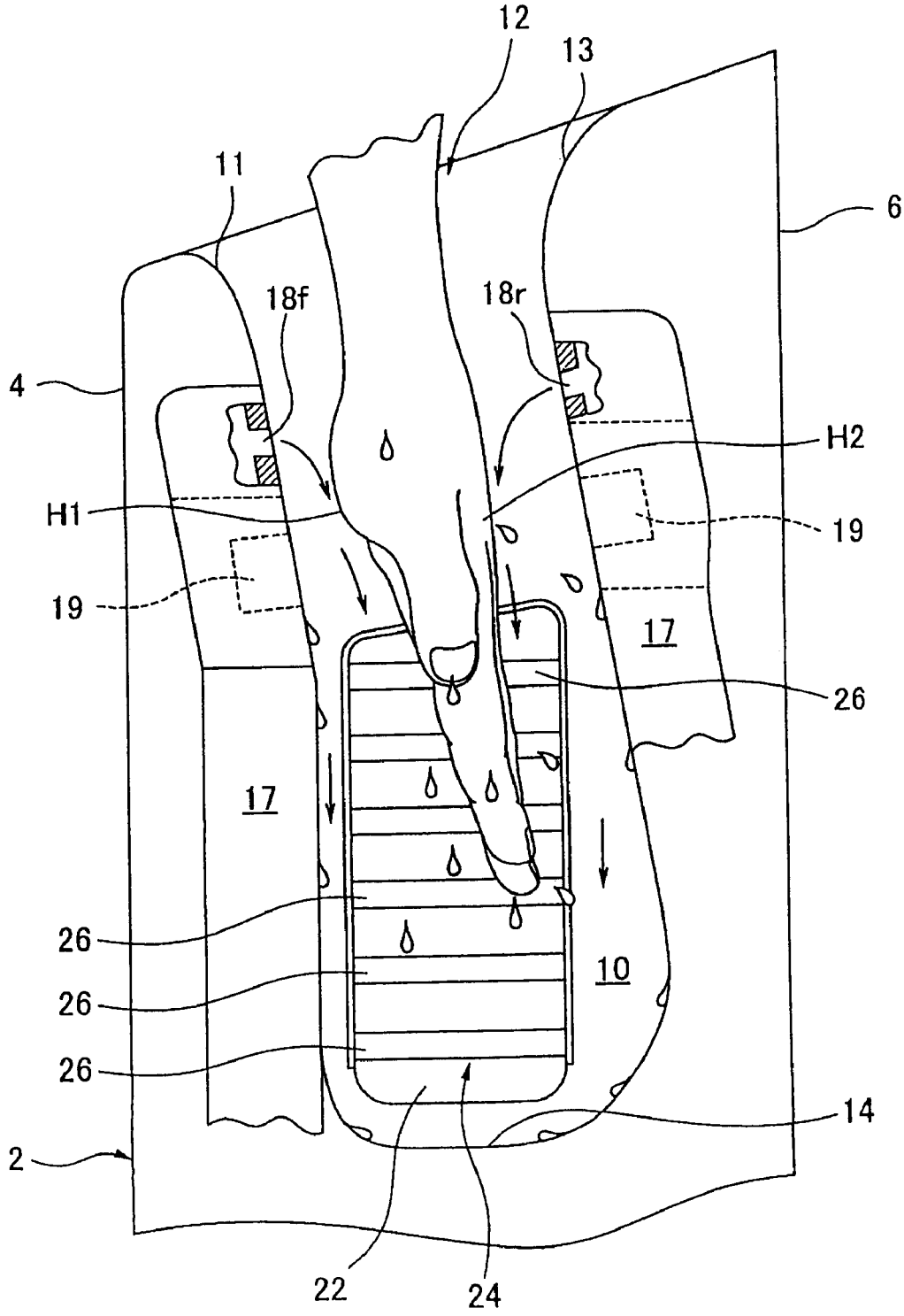
FIG. 6 is a partial expanded section as seen along line B-B in FIG. 2 showing the state in which hands are inserted.
Figure 7:
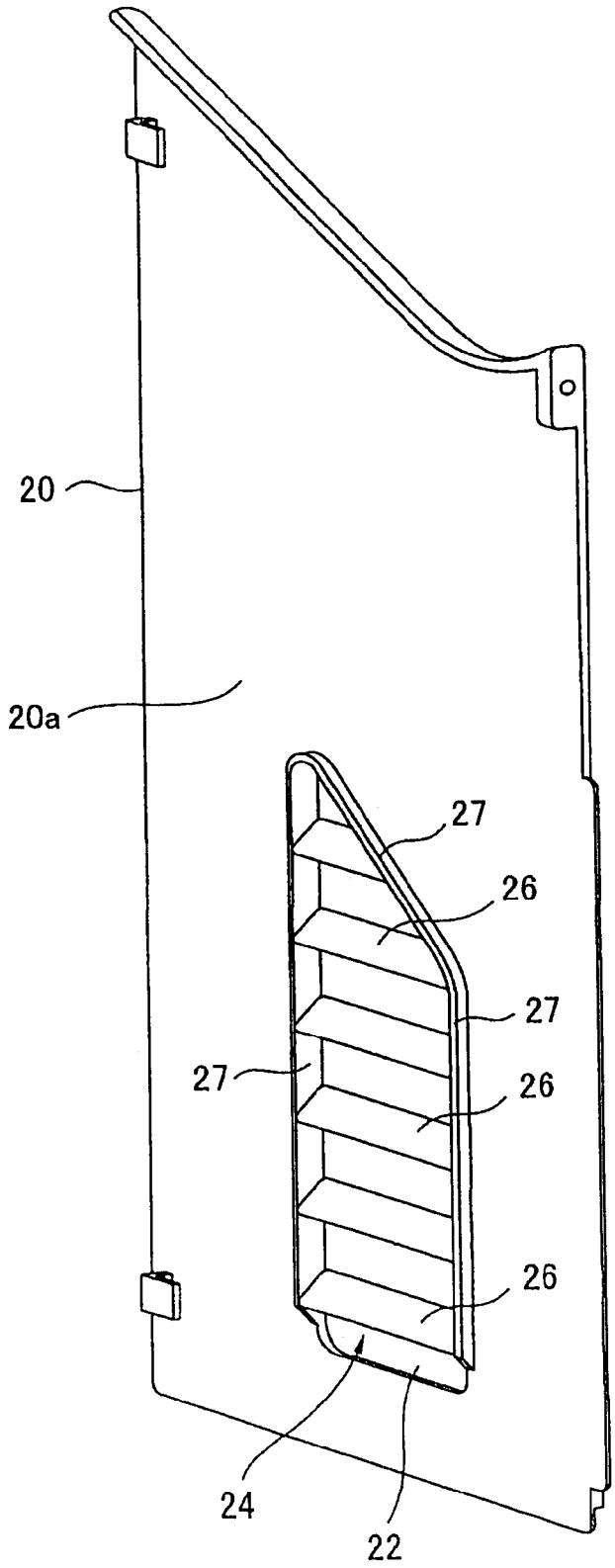
FIG. 7 is a perspective view from the inside of the right side cover of the hand dryer of the first embodiment.
Figure 8:
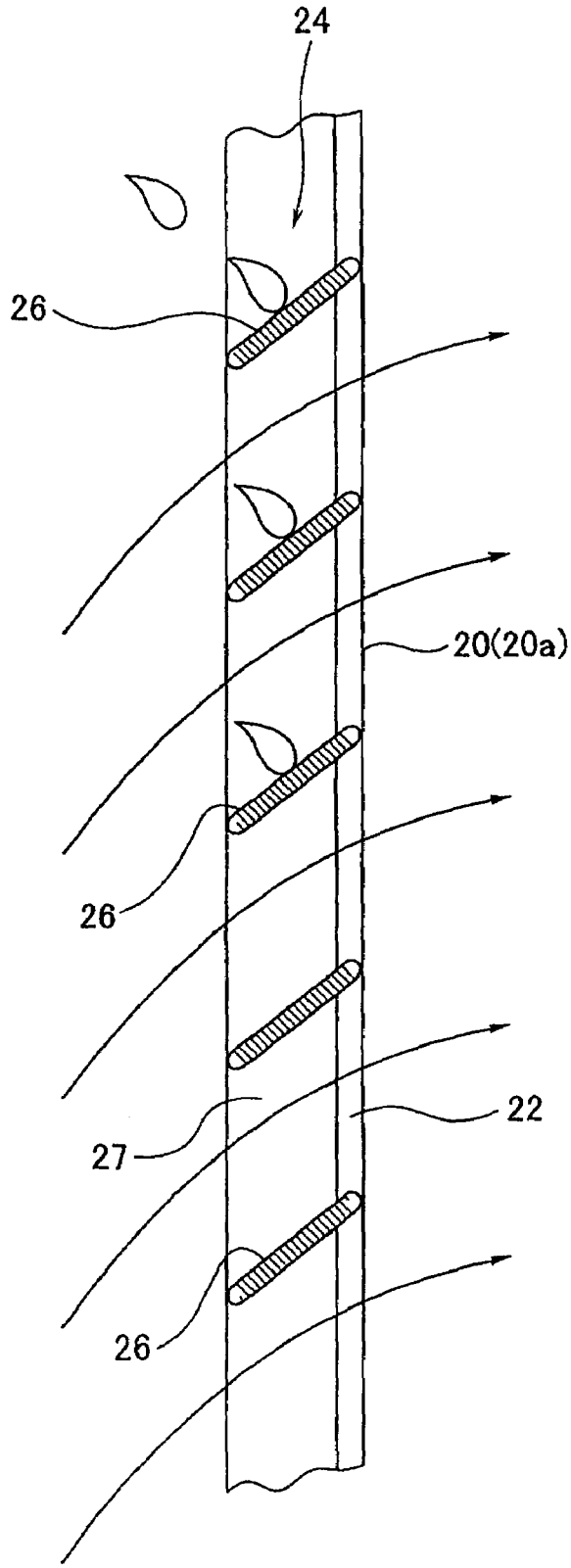
FIG. 8 is an expanded view of the louver of the first embodiment.
Figure 9:
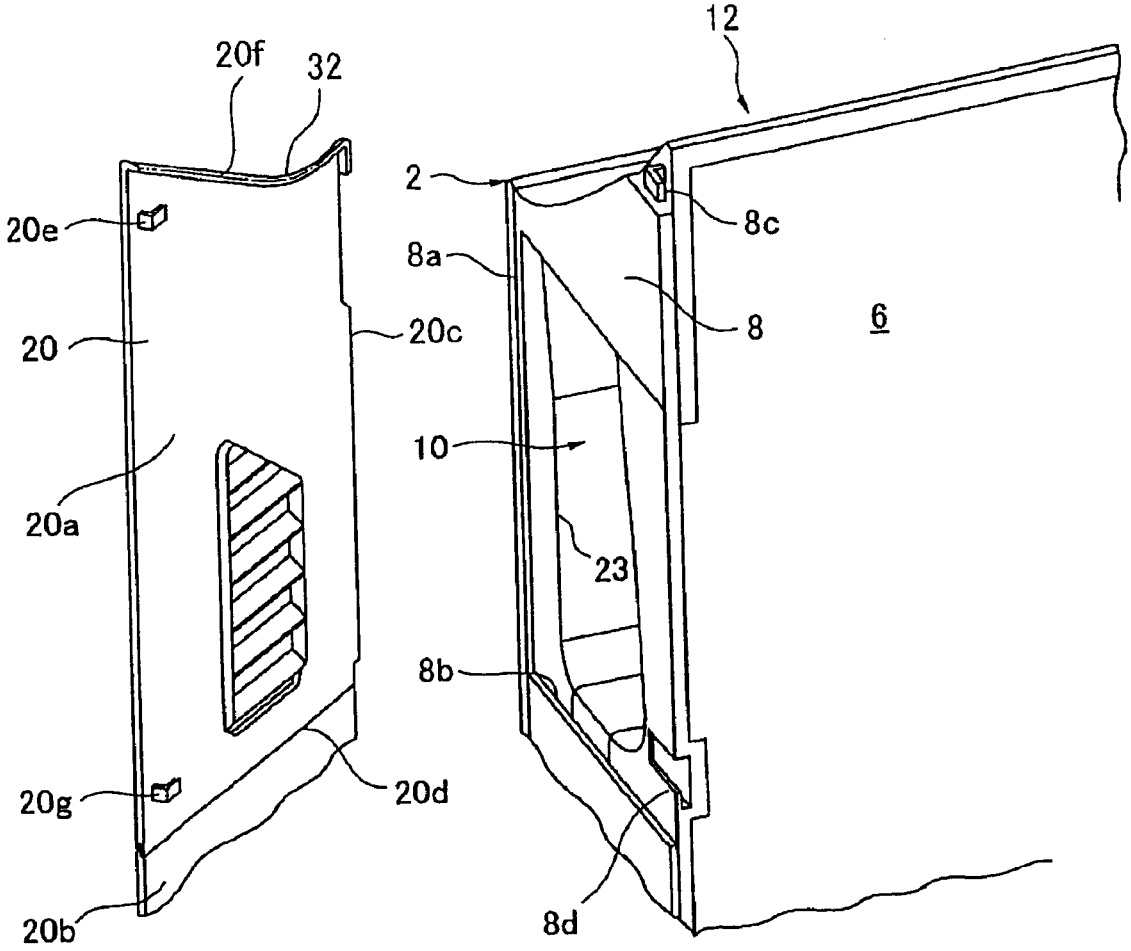
FIG. 9 is an exploded perspective view showing the state in which the right side cover in the first embodiment is attached.

FIG. 2 is a perspective view showing a hand dryer according to a first embodiment of the present invention. FIG. 3 is an exploded perspective view showing the hand dryer of the first embodiment. FIG. 4 is a sectional view along line A-A in FIG. 2; FIG. 5 is a partial expanded section as seen along line A-A in FIG. 2, showing the state in which hands are inserted. FIG. 6 is a partial expanded section as seen along line B-B in FIG. 2, showing the state in which hands are inserted. FIG. 7 is a perspective view from the inside of the right side cover of the hand dryer of the first embodiment. FIG. 8 is an expanded view of the louver of the first embodiment. FIG. 9 is an exploded perspective view showing the state in which the right side cover in the first embodiment is attached.

As shown in FIGS. 2 through 6, the hand dryer 1 according to the first embodiment has a main housing 2, and this main housing 2 is formed in a box shape by a front member 4, a back member 6, and side members 8 disposed on both sides.

Moreover, a hand drying chamber 10 into which a user can insert hands H is formed on the main housing 2; this hand drying chamber 10 is formed by a front side wall portion 11 which forms the front side wall, a rear side wall portion 13 which forms the rear side wall, and a bottom portion 14 which forms the bottom surface, and is further provided with a hand insertion opening portion 12 which opens at the top thereof (see FIG. 6).

Here, the main housing 2 front member 4 is formed as a separate member, and can be attached to members other than the main housing 2 after devices such as the electric blower 16 described below are attached to the back member 6 and the like of the main housing 2.

Two electric blowers 16 are housed within the lower interior of the main housing 2. A plurality of nozzles 18 (18*f*, 18*r*) are horizontally disposed at equal intervals in an essentially linear form in order to blow the air flow fed from the electric blower 16 toward hands H inserted into the hand drying chamber 10. Note that the air flow from the electric blower 16 passes through an air duct 17 (see FIG. 6) and is supplied to the nozzles 18.

Also, as shown in FIGS. 2 through 5, the nozzles 18 are formed as a horizontal array of small diameter holes; the arrangement of the small holes may be in a zigzag pattern, or in an array at varying intervals, and the shape of the nozzle may also be formed as a long horizontal slit shape rather than as a plurality of small holes.

Next we will explain the orientation of the nozzle 18 (the direction at which air is blown out of the nozzle). As depicted in FIG. 6, the hand drying chamber 10, by positioning the hand insertion opening portion 12 formed by the front side wall portion 11 and the rear side wall portion 13 to be on the front side, and the bottom portion 14 to be on the rear side, is formed to extend diagonally downward from the front side to the rear side, thus facilitating the insertion of the user's hands H. The direction of the nozzle 18 is referenced on the direction perpendicular to the direction of hand insertion, which is to say the longitudinal direction of the hand drying chamber 10, and is furthermore set so as to be slightly more downward pointing than this reference. Specifically, the nozzle 18 direction is set so as to point slightly more downward than the perpendicular direction described by the respective planes (which are set to be parallel to the direction of hand insertion) of the front side wall portion 11 and the respective rear side wall portions 13 of the hand drying chamber 10, as shown in FIG. 6.

As shown in FIGS. 3 through 6, sensors 19 (19*f*, 19*r*) for detecting hands H inserted into the hand drying chamber 10 are respectively disposed in a lower portion in which the nozzles 18 are disposed on the front side wall portion 11 and the rear side wall portion 13 of the hand drying chamber 10 in the main housing 2.

As shown in FIGS. 2 and 3, a side cover 20 is removably attached on each of the respective sides on the outside of side members 8 on the main housing 2. The side cover 20 is vertically split in two between an upper side cover 20*a* and a lower side cover 20*b*. A trapezoidal ventilation opening portion 22 is formed on the upper side cover 20*a*. Specifically, the ventilation opening portion 22, as shown in FIG. 4, is formed at a part of the side covers 20 positioned near to and above the hand drying chamber 10 bottom portion 14. Because the ventilation opening portions 22 are formed on the side covers 20, ventilation interior opening portions 23 are formed on the main housing 2 side members 8 at a position corresponding to these ventilation opening portions 22.

These ventilation opening portions 22 exhaust air flow in the hand drying chamber 10 to the outside in such a way that air flow blown out from the above-described plurality of nozzles 18 is not blown back from the hand insertion opening portion 12 on the top of the hand drying chamber 10.

Moreover, louvers 24 for preventing splattering of water droplets in the hand drying chamber 10 to the outside are disposed on these ventilation opening portions 22.

Here the upper side cover 20*a* and the lower surface cover 20*b* are respectively split into two parts above and below, but an integral structure combining the upper and lower parts in place of the two part divided structure is also acceptable.

As shown in FIGS. 7 and 8, the louvers 24 provided on the ventilation opening portions 22 of the side covers 20 comprise a plurality of plate-shaped members 26 vertically disposed at intervals spanning the ventilation opening portions 22. Here, a dimension greater than 6 mm and less than 10 mm is preferable as the width of the plate-shaped members 26. A dimension of greater than 10 mm and less than 15 mm is preferable for the interval (ventilation portion) between adjacent plate-shaped members 26 in the vertical direction.

These plate-shaped members 26 are arrayed at an angle so as to form a rising inclination from the inside toward the outside of the hand drying chamber 10. As a result, when air flow seeking to rise along the side covers 20 contacts the plate-shaped members 26, the direction in which the air flow advances can easily change toward the outside of the hand drying chamber, as shown in FIG. 8, so that air flow is exhausted out of the hand drying chamber 10 through the gaps between the plate-shaped members 26.

Moreover, as shown in FIGS. 5 and 8, each of the louver 24 plate-shaped members 26 is disposed so as to protrude into the hand drying chamber 10 further than the side cover 20 (upper side cover 20*a*) inside wall; therefore the air flow rising along the inside surface of the side covers 20 in the hand drying chamber 10 is easier to induce into the ventilation opening portions 22 due to the plate-shaped members 26, resulting in the ability to quickly exhaust the air flow out of the hand drying chamber 10.

Here, as shown in FIGS. 5 through 8, the sectional shape of the plate-shaped members 26 in the hand dryer 1 is tabular, but the shape is not restricted to this form, and may also be wing-shaped or curved. By adopting a sectional shape for the plate-shaped members 26 which has a rising inclination from the inside toward the outside, is essentially horizontal on the outside, and has a protruding wing or curved shape on top, the direction in which the air flow is exhausted from the ventilation opening portions 22 can be made horizontal rather than upward. In such cases, the exhausted air flow would not impart discomfort by blowing on the faces of persons standing near the hand dryer 1.

Furthermore, as shown in FIG. 7, a rib 27 protruding into the hand drying chamber 10 is formed continuously along the top and side edge portions of the upper side cover 20*a* ventilation opening portions 22.

Next, as shown in FIGS. 3 and 4, the outside surface of the main housing 2 side members 8 has a channeled shape, and a vertically extending drain path 28 is formed by the outside surface of the side members 8 and the inside surface of the side covers 20 (upper surface covers 20*a*). The top end of the drain path 28 communicates via the hand drying chamber 10 left and right end edge portions 14*a* and 14*b* of the bottom portion 14, and the drain path 28 formed on the side members 8. Here the bottom portion 14 left and right end edge portions 14*a* and 14*b* are formed to have a gently curving surface (curvature radius R≧2 mm), smoothly connecting the bottom portion 14 and the drain path 28 drain opening 28*a*. The reason for forming the left and right end edge portions 14*a* and 14*b* of the bottom portion 14 to have a gently curved surface, which is to say a curvature radius R greater than 2 mm, is to enable water droplets adhering to the bottom portion 14 to flow into the drain path 28 without removal from the bottom portion 14 when they are blown in by wind air flow. At the same time, if the curvature radius R is less than 2 mm, the pushed out water droplets can undesirably overcome surface tension and become air-blown.

The drain path 28 formed on the outside surface of the main housing 2 side members 8 is exposed when the side covers 20 are removed from the main housing 2.

Note that, as shown in FIG. 3, the ventilation interior opening portions 23, the drain opening 28*a*, and the drain path 28 are integral structures in the side members 8.

A recovery container 30 which serves as a water receptacle is removably built into the hand dryer 1 main housing 2 at the bottom end portion of the drain path 28, and recovery openings 30*a*, 30*b* in this recovery container 30 are disposed in positions facing the bottom end portion of the drain path 28. Also, as shown in FIG. 4, the bottom portion of the drain path 28 describes a gently curved shape and is inserted inward toward the main housing 2, reaching the recovery openings 30*a*, 30*b*.

Next, as shown in FIG. 9, the upper side cover 20*a* has a size and shape capable of covering the side surface of the front member 4, and a upper flange portion 20*f*, a front flange portion 20*c*, and a lower flange portion 20*d* are formed in the circumferential part thereof, while an upper catch portion 20*e* and lower catch portion 20*g* are formed on the inner surface thereof. A channel 8*a* into which the upper side cover 20*a* front flange portion 20*c* is inserted, a lower insertion portion 8*b* into which a lower flange portion 20*d* is inserted, an upper receiving portion 8*c* which engages an upper catch portion 20*e*, and a lower receiving portion 8*d* which engages a lower catch portion 20*g* are formed in the main housing 2 side members 8. With this type of structure, the upper side cover 20*a* can be removably attached to the main housing 2 side members 8.

Here, when attaching the upper side covers 20*a* to the main housing 2, the upper side covers 20*a* front flange portions 20*c* are first inserted into the channels 8*a* on the side members 8, then the upper side covers 20 are fit to the side surface of the main housing 2 hand drying chamber 10, and the lower flange portions 20*d* are inserted into the lower insertion portions 8*b* of the side members 8. The upper catch portion 20*e* and lower catch portion 20*g* on the upper side covers 20*a* are then respectively engaged by the upper receiving portion 8*c* and lower receiving portion 8*d* on the side members 8 and, upon engagement of the upper flange portion 20*f* with the upper side of the hand drying chamber 10, attachment is completed. The reverse order can also be followed to remove the upper side covers 20*a* from the main housing 2.

This type of structure enables the upper side covers 20*a* to be removably attached to the side members 8 of the main housing 2.

In cases, for example, such as when the upper side covers 20*a* are dirtied, the upper side covers 20*a* can, as needed, be removed from the main housing 2 and washed, thus offering good cleanability and maintainability.

Furthermore, as shown in FIGS. 2 and 3, in the first embodiment hand dryer 1 a downwardly concave arc-shaped portion 32 is formed in the side members 8 and the side covers 20 by downwardly curving these members close to the center of their respective top edge portions. Here, the lowest portion of the arc-shaped portion 32 is disposed at a position higher than the nozzles 18.

Next we will describe the operation of the hand dryer 1 according to the first embodiment of the aforementioned present invention.

As shown in FIGS. 5 and 6, the insertion by a user of hands H into the hand drying chamber 10 causes the detection thereof by a sensor 19 and the automatic operation of the electric blower 16, whereby an air flow is blown out from the nozzles 18 toward hands H. At this time, air is blown onto the back side H2 of the user's hands H from a plurality of nozzles 18*r*, and air is blown onto the palm side hand H1 from a plurality of nozzles 18*f*. An air flow is thus simultaneously blown onto the palm side H1 and the back side H2 of the user's hands H, and the user's hands H can be dried by the blowing of water droplets adhering to both sides of the user's hands H.

We will first explain the flow of air leaving the nozzles 18 in the hand dryer 1. Air flow blown from the nozzle 18*r* hits the back side H2 of the hands H and changes direction, splitting into an upward and downward flow along the surface of the back side H2. The air flow blown from the nozzle 18*f* hits the palm sides H1 of the hands H and changes direction, splitting into an upward and downward flow along the surface of the back sides H1.

At this point, as shown in FIG. 6, because the user's hands H are wedge-shaped, being thick at the wrists and becoming gradually thinner toward the fingertips, the majority of the air flow contacting hands H inserted in the hand drying chamber 10 flows toward the fingertips, which is to say toward the bottom portion 14 of the hand drying chamber 10.

At the same time, when air flow diagonally contacts the inner surfaces of the front side wall portion 11, the rear side wall portion 13, and the side members 8, the direction of the angle formed by the direction of air flow advance and the contacted surface increases, such that the majority of the air flow flows along the front side wall portion 11, the rear side wall portion 13, and the side members 8.

Moreover, the direction of the nozzles 18*f* and 18*r* is set, as described above, to be slightly lower than the direction perpendicular to the respective planes of the front side wall portion 11 and the rear side wall portion 13, so that moisture adhering to the hands H inserted from the hand insertion opening portion 12 into the hand drying chamber 10 can be easily blown toward the bottom portion 14 of the hand drying chamber 10. Also, because the hand is wedge-shaped, and the nozzle direction is set to point slightly downward, the air flow falling down along the hands H increases, resulting in a relatively small air flow rising along the hands H, and a reduction in the blowback from the hand insertion opening portion 12 on the top surface of the hand drying chamber 10.

As depicted in FIG. 5, the air flow blown out of the plurality of nozzles 18*f* and 18*r* changes direction upon contact with the bottom portion 14 of the hand drying chamber 10 and flows toward the left and right sides along the bottom portion 14. As shown in FIG. 5, the shape of the bottom portion 14 has a declining sloped surface in the left and right directions, with the area around the center of the bottom portion 14 being the peak, therefore air flow which has contacted the bottom portion 14 is split to the left and right, with the area around the center corresponding to that peak being the dividing line thereof, and each side advancing toward the respective left and right side covers 20.

These air flows contact the inside surface of the side covers 20 respectively disposed on the left and right sides to become an upward flow, and then seek to flow upward along the side covers 20. In the present embodiment, the ventilation opening portions 22 are formed in a part of the side covers 20 positioned to be near to and above the bottom portion 14 of the hand drying chamber 10, so that before the air flow flowing along the bottom portion 14 becomes a rising flow and rises along the side covers 20 it is quickly exhausted to the outside from the ventilation opening portions 22. At this time, the plurality of plate-shaped members 26 in the embodiment are arrayed on the ventilation opening portion 22 with a predetermined intervals interposed therebetween such that a rising slope is formed from the inside toward the outside, so that a rising flow is induced upward along the slope of each of the plate-shaped members and smoothly exhausted outward. Thus in the present embodiment the air flow can be even more quickly exhausted to the outside, and ventilation can be greatly improved.

By disposing the ventilation opening portions 22 in this manner, the bottom portion 14 can be made invisible from the outside, thus yielding a further design effect.

In the hand dryer 1 of the first embodiment, an arc-shaped portion 32 has been formed curving downward toward the top edge portion of the side covers 20, so that when viewed from the hand dryer 1, the bottom surface of the arc-shaped portion 32 recedes from view, and the hand insertion opening portion 12 on the top surface of the hand drying chamber 10 appears to be wider than actual size due to the perspective effect. Causing the user to perceive the hand insertion opening portion 12 as being broader than actual size can alleviate the sense of restriction when inserting hands into the hand drying chamber 10.

By forming a downwardly curving arc-shaped portion 32 in the side covers 20, the air flow rising along the side covers 20 can more easily escape to the outside from that portion of the arc-shaped portion 32 which is at a low position. Moreover, light entering from the hand insertion opening portion 12 reaches the relatively deep position of the hand drying chamber 10, yielding a skylight effect.

Next we will explain the flow of water droplets blown from the hands H in the first embodiment. As shown in FIG. 6, when air flow is blown from the nozzles 18*f* and 18*r* onto the hands H inserted in the hand drying chamber 10, the moisture adhering to the surface of the hands H is pushed along by the air flow across the surface of the hands H and moves to the fingertips thereof, after which it is blown off by the air flow. At this time, water droplets blown from the hands H are, as shown in FIG. 6, blown downward as they spread out in an essentially radial shape due to the mutual actions of the downward air flow generated within the hand drying chamber 10, and gravity.

A portion of the water droplets blown from the hands H impacts on the inside surface of the side covers 20 (the upper side cover 20*a*), another portion is blown toward the ventilation opening portions 22, and the remainder adheres to the hand drying chamber 10 front side wall portion 11, rear side wall portion 13, or bottom portion 14. However, since a plurality of plate-shaped members forming a rising slope from the inside to the outside thereof is disposed on the ventilation opening portion 22, the water droplets are impeded by those plate-shaped members 26, impacting the top surface of the plate-shaped members 26 and adhering thereto, so that penetration by the water droplets of the ventilation opening portions 22 and splattering to the outside can be prevented. Therefore when viewed in the direction of water droplet splatter, a more effective water droplet splatter prevention function can be obtained by arraying the plurality of plate-shaped members 26 so that they appear to be mutually overlapping, without interposing gaps.

Here, as shown in FIG. 8, because the top surface of these plate-shaped members 26 forms a rising slope from the inside toward the outside, water droplets adhering to the top surface of the plate-shaped members 26 seek to fall downward toward the interior of the hand drying chamber 10 due to gravity. It is therefore possible to exhaust only the air flow to the outside of the ventilation opening portions 22, without water droplets being blown outside by the air flow blowing along the plate-shaped members 26 inside the ventilation opening portions 22.

As shown in FIG. 7, the rib 27 protruding into the hand drying chamber 10 on the side covers 20 is continuously disposed along the top edge portion and side edge portions of the ventilation opening portions 22, therefore the rib 27 functions as an overhang during hand drying, such that water droplets blown from wet hands H and adhering to the inside surface of the side covers 20 in the hand drying chamber 10 pass over the top surface of the rib 27 and flow downward so as to avoid the ventilation opening portions 22, thereby preventing the water droplets from passing directly through the ventilation opening portions 22 and splattering to the outside. Also, by disposing a continuous rib 27 in this type of part, the strength of the ventilation opening portions 22 around the top edge portion and the side edge portions can be greatly improved.

As described above, according to the present embodiment the moisture adhering to the surface of hands H becomes water droplets blown by the air flow, but splattering of these water droplets is effectively prevented by the plate-shaped members 26, the rib 27, and so forth. Superior water sealing is thus obtained with the present embodiment.

As described above, the air flow blown from the plurality of nozzles 18 into the hand drying chamber 10 hits wet hands and proceeds downward, then hits the bottom portion 14 in the hand drying chamber 10, bends outward along the surface of the bottom portion 14 and is exhausted quickly from the upper side cover 20*a* ventilation opening portions 22 to the outside. Therefore in the present embodiment, no blowback of air flow from the hand insertion opening portion 12 occurs, and there is no splattering of water droplets from the hand insertion opening portion 12, so that superior drying performance can be obtained.

We will next explain the drain action with respect to water droplets blown from the hands H. Water droplets blown from hands inserted into the hand drying chamber 10 adhere to the front side wall portion 11 and rear side wall portion 13 of the hand drying chamber 10, or fall to the bottom portion 14; water droplets adhering to the front side wall portion 11 and rear side wall portion 13 are pushed by the air flow blown out from the nozzles 18 and collected in the bottom portion 14, after which they are pushed by the air flow pushed out from the nozzles 18, and further flow down to the edge portions 14*a* and 14*b* of the bottom portion 14, together with water droplets falling on to the bottom portion 14, finally flowing through the drain opening 28*a* and out the drain path 28 into the recovery openings 30*a* and 30*b*, to be recovered in the recovery container 30.

As shown in FIG. 4, the bottom portion 14 in the hand drying chamber 10 is formed to have an inclined surface forming a downward slope from the center of the bottom portion 14 toward the left and right sides thereof, so that water droplets falling on the bottom portion 14 fall under gravity and flow along the inclined surface; these water droplets are then further blown by the air flow blown from the nozzles 18 toward the outer side along the bottom portion 14, and are quickly induced toward the left and right edge channel portions 14*a* and 14*b*, thus enabling an improvement in draining characteristics within the hand drying chamber 10.

The bottom end portion of the drain path 28 is inserted into the main housing 2 at a gentle incline, and the recovery openings 30*a*, 30*b* on the recovery container 30 are disposed in a position corresponding thereto, so that the recovery container 30 can be formed without protruding from the main housing 2 and, moreover, can be formed to be smaller than the main housing 2. As a result, the hand dryer 1 achieves a simple design, and cleanliness can be maintained without compromising aesthetic appeal and without dirtying floors or the like.

Moisture thus crosses over the surface portion of the main housing 2 containing an electric blower 16 or the like, flows downward, and is expelled, so that there is no leakage or immersion of the electric blower or the like built into the main housing from a drain hose disposed within the main housing.

Moreover, as shown in FIG. 3, separating the upper side cover 20*b* from the main housing 2 exposes the drain path 28 to the outside, permitting the drain path 28 to be easily cleaned by wiping.

Figure 10:
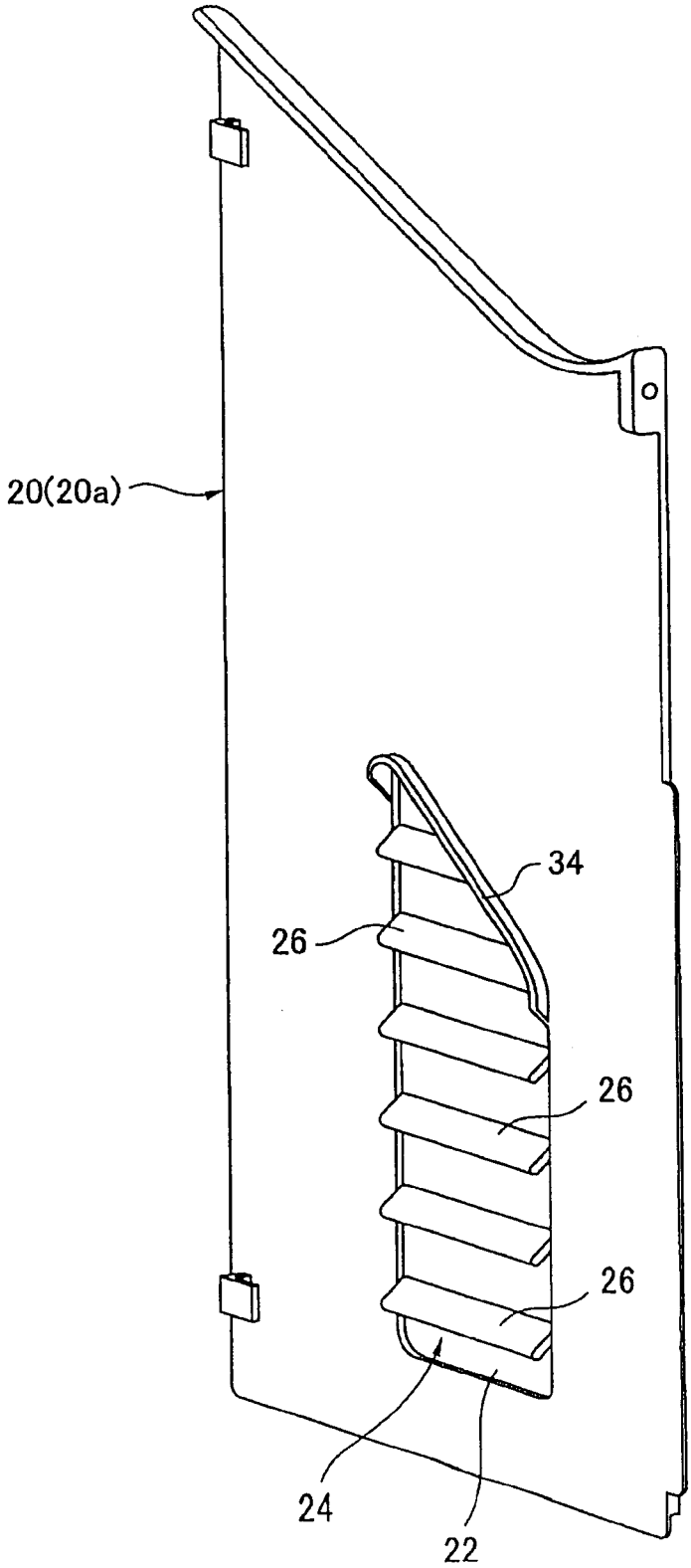
FIG. 10 is a perspective view as seen from the inner side of the upper side cover member according to a first variation of the first embodiment of the present invention.

Next, referring to FIG. 10, we will explain the side cover 20 (upper side cover 20*a*) according to a first variation of the first embodiment of the present invention. FIG. 10 is a perspective view as seen from the inner side of the upper side cover member according to a first variation of the first embodiment of the present invention.

As shown in FIG. 10, in this first variation of the first embodiment the rib 34 is disposed only in the vicinity of the upper edge portion of the ventilation opening portion 22 on the upper side cover 20*a*. By providing the rib 34 at this type of part, the rib can function as an overhang during hand drying, similar to the rib 27 described above, so that water droplets blown from hands can be prevented from splattering to outside of the ventilation opening portions 22.

Figure 11:
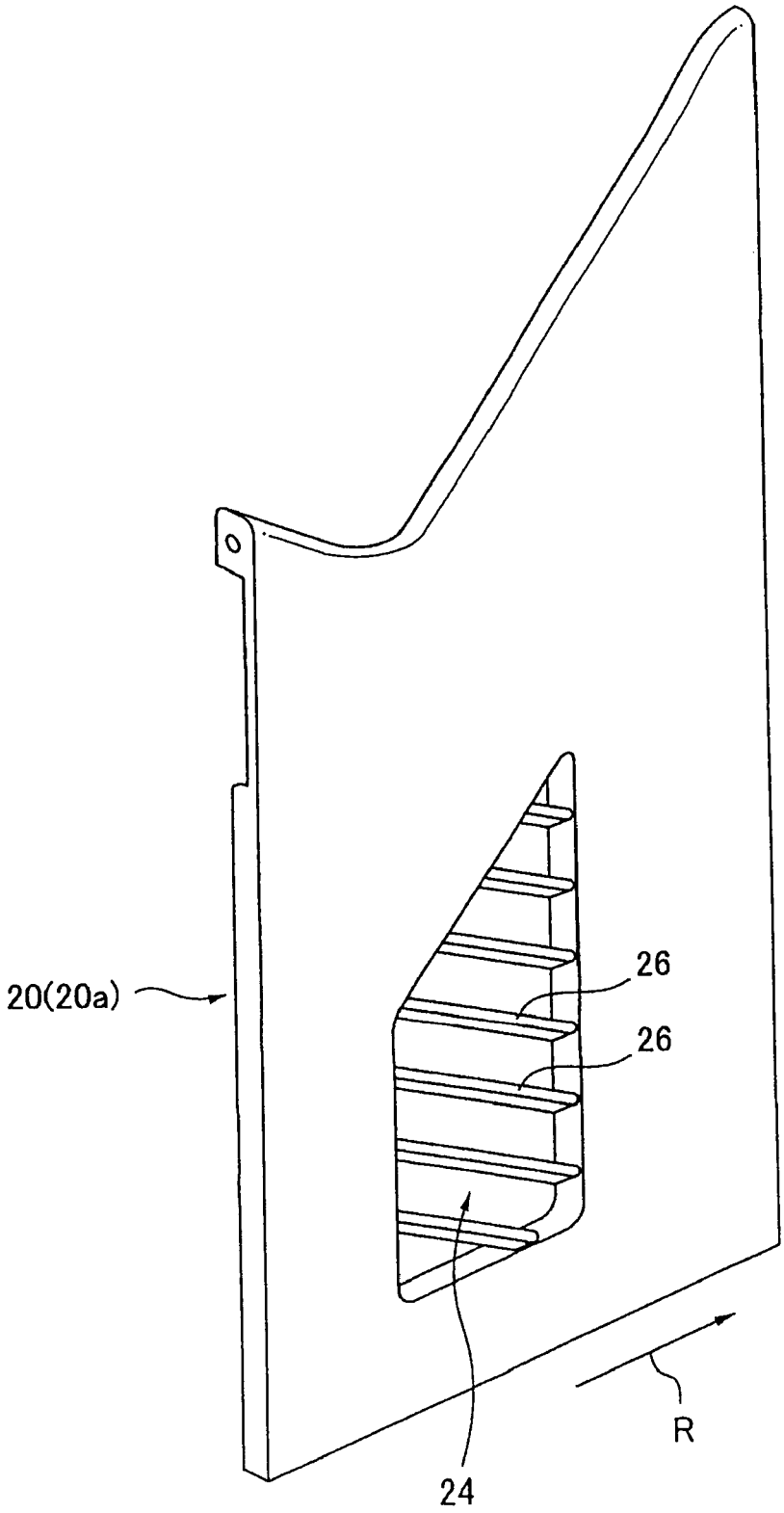
FIG. 11 is a perspective view as seen from the outer side of the upper side cover member according to a second variation of the first embodiment of the present invention.

Next, referring to FIG. 11, we will explain the side cover 20 (upper side cover 20*a*) according to a second variation of the first embodiment of the present invention. FIG. 11 is a perspective view as seen from the outer side of the upper side cover member according to a second variation of the first embodiment of the present invention. As shown in FIG. 11, in a second variation of the first embodiment a plurality of plate-shaped members 26 forming the louvers 24 in the upper side cover 20*a* are disposed so as to form a downward slope toward the rear side (in the direction of the arrow R) of the hand dryer 1.

By so doing, in the second embodiment water droplets blown from wet hands during drying impact and adhere to these plate-shaped members 26, then flow downward along this descending slope, so that the water droplets adhering to a plurality of plate-shaped members 26 can be recovered in a single location, and immersion by the water droplets of parts within the hand dryer for which such immersion is undesirable can be prevented, thereby also improving the durability of the hand dryer.

Figure 12:
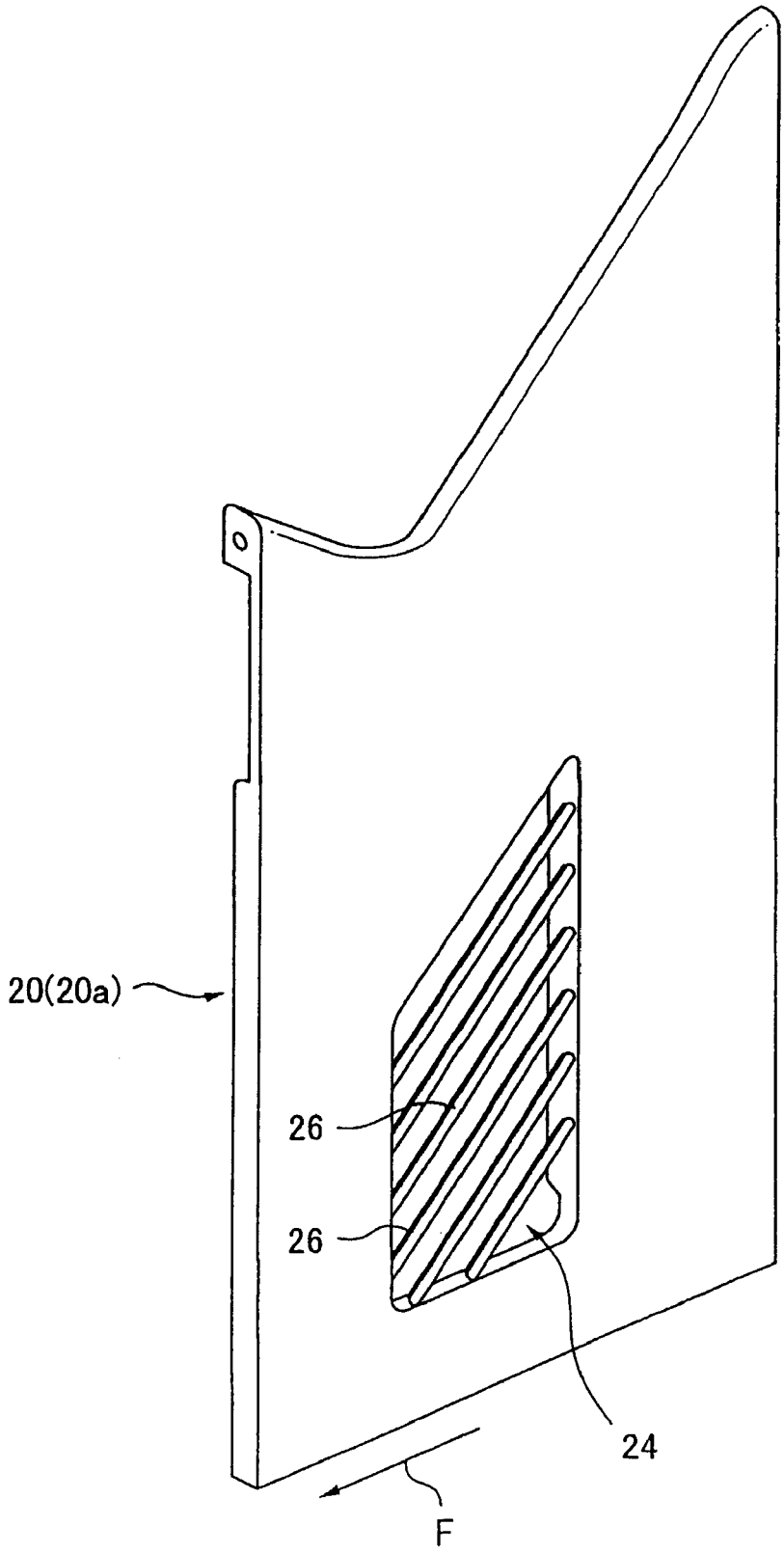
FIG. 12 is a perspective view as seen from the outer side of the upper side cover member according to a third variation of the first embodiment of the present invention.

Next, referring to FIG. 12, we will explain the side covers 20 (upper side cover 20*a*) according to a third variation of the first embodiment of the present invention. FIG. 12 is a perspective view as seen from the outer side of the upper side cover member according to the third variation of the first embodiment of the present invention.

As shown in FIG. 12, in a third variation of the first embodiment a plurality of plate-shaped members 26 forming the louvers 24 in the upper side cover 20*a* are disposed so as to form a downward slope facing the front side (in the direction of the arrow F) of the hand dryer 1.

By so doing, in the third variation, as in the above-described second variation, water droplets blown from wet hands during drying impact and adhere to these plate-shaped members 26, then flow downward along the descending slope thereof, so that water droplets can be efficiently recovered in a single location.

Figure 13:
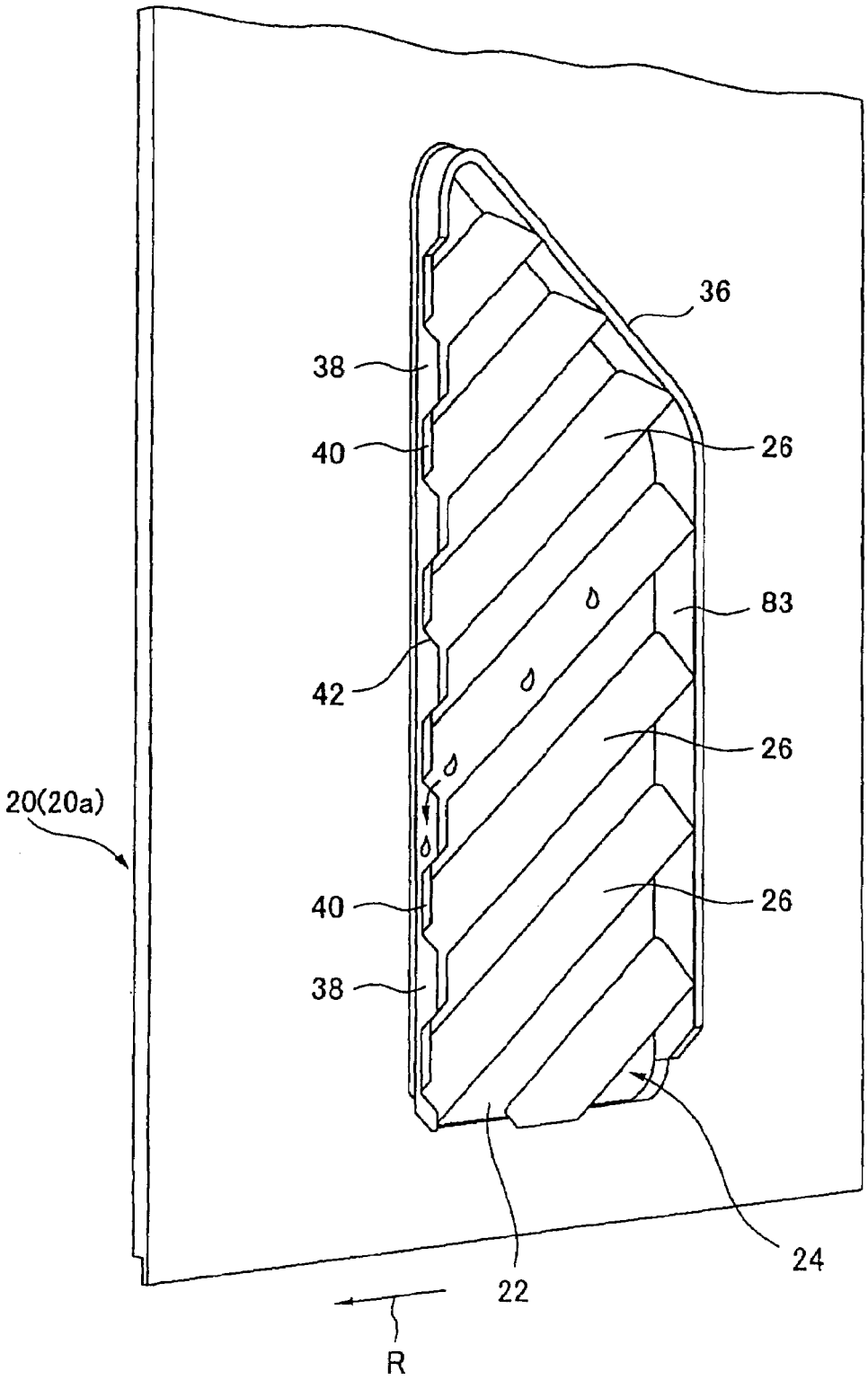
FIG. 13 is a perspective view as seen from the outer side of the upper side cover member according to a fourth variation of the first embodiment of the present invention.

Next, referring to FIG. 13, we will explain the side covers 20 (upper side covers 20*a*) according to a fourth variation of the first embodiment of the present invention. FIG. 13 is a perspective view as seen from the inner side of the upper side cover member according to a fourth variation of the first embodiment of the present invention.

As shown in FIG. 13, in a fourth variation of the first embodiment a plurality of plate-shaped members 26 forming the louvers 24 in the upper side cover 20*a* are disposed so as to form a downward slope facing the rear side (in the direction of the arrow R), while at the same time a continuous rib 36 is disposed at a position on the high side of each of the plate-shaped members 26, and high ribs 38 and low ribs 40 are alternately disposed in a part positioned on the low side thereof. Moreover, a connecting portion 42, formed to be continuous with the upper surface of each of the plate-shaped members 26, is provided between these high ribs 38 and low ribs 40.

According to the fourth variation thus constituted, water droplets adhering to the upper surface of each of the plate-shaped members 26 constituting the louvers 24 flows down along the downward slope thereof and flows out to the outside surface of the high ribs 38 through a connecting portion 42 connected to the upper surface of the plate-shaped members 26.

This means that water droplets adhering to the top surface of each of the plate-shaped members 26 can always be induced to the outside of the high ribs 38 and the low ribs 40, and splattering of water droplets from the ventilation opening portions 22 can be prevented.

Figure 14:
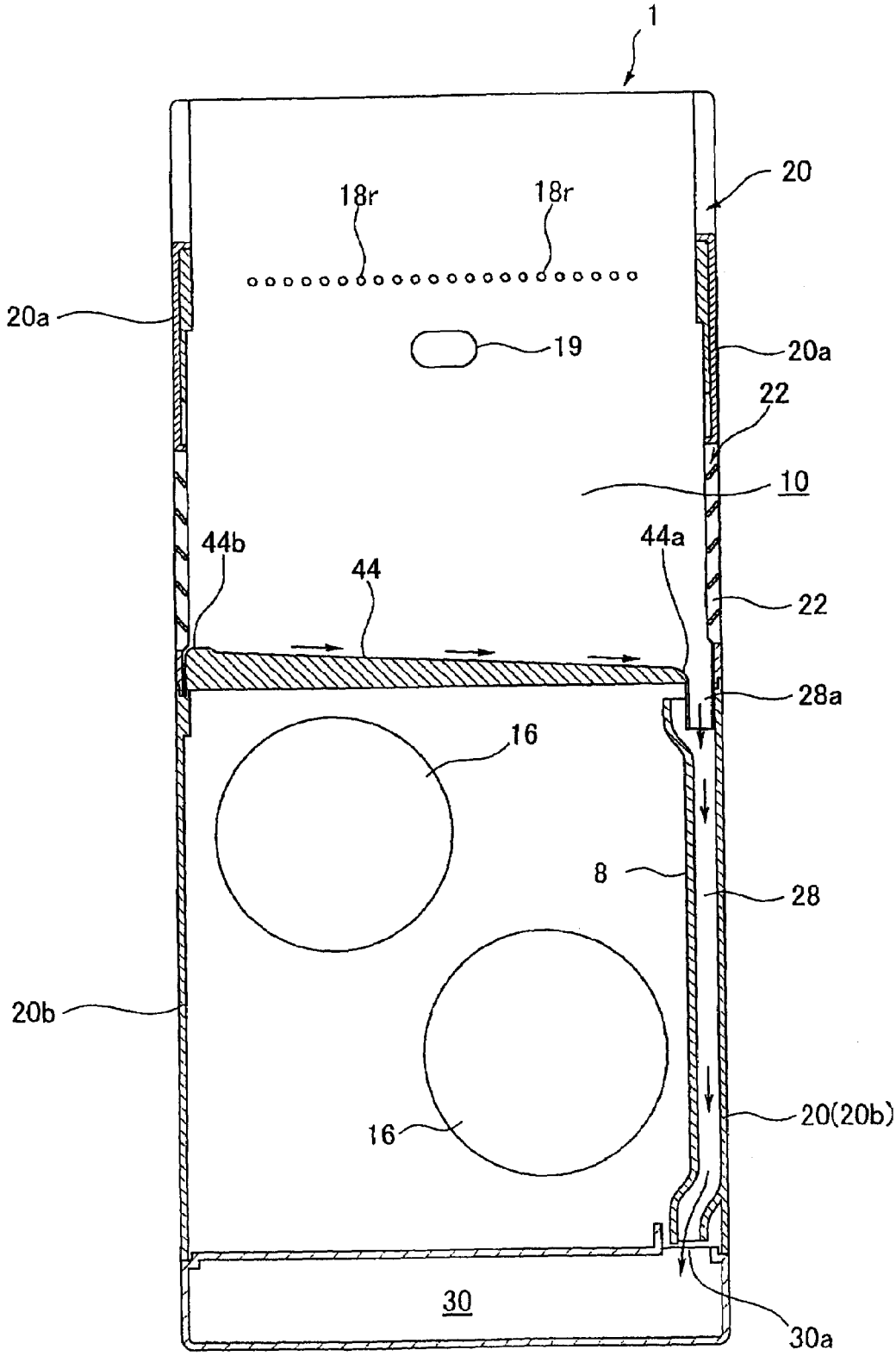
FIG. 14 is a sectional view seen along the line A-A in FIG. 2 of a fifth variation of the first embodiment of the present invention.

Next we will explain a fifth variation of the first embodiment. FIG. 14 is a sectional view seen along the line A-A in FIG. 2 of a fifth variation of the first embodiment of the present invention. As shown in FIG. 14, in the fifth variation of the first embodiment, the drain path 28 is disposed only on the right side. For that reason, the bottom portion 44 of the hand drying chamber 10 of the hand dryer 1 is formed as an inclined surface constituting a downward slope from the left edge channel portion 44*b* toward the right edge channel portion 44*a*, and furthermore a curved surface is formed in the right edge channel portion 44*a* in order to induce moisture toward the drain path 28 via the drain opening 28*a*.

Previous hand dryers exist in which water is drained from a drain hose provided in the vicinity of the two side portions of the bottom portion of the hand drying chamber, but these require that the side portions be raised in order to prevent lateral leakage of moisture from the sides, thus making cleaning difficult due to the obstacle presented by these raised portions. However, by using the hand dryer 1 of the fifth variation, cleaning of the bottom portion 44 can be easily accomplished by wiping down along the inclined surface, thus saving the work required in the past to wipe up dirt accumulated in corners, scoop out water, and the like.

Furthermore, according to the fifth variation hand dryer 1, the bottom portion 44 right edge channel portion 44*a*, drain opening 28*a*, drain path 28, and recovery container 30 recovery opening 30*a* are disposed on only the right side of the main housing 2, making this a useful structure in cases where, for example, sufficient cleaning space cannot be secured on the left side of the hand dryer 1. Note that depending on the installation environment, a structure is also possible in which the drain path and the like are disposed only on the left side of the hand dryer.

Figure 15:
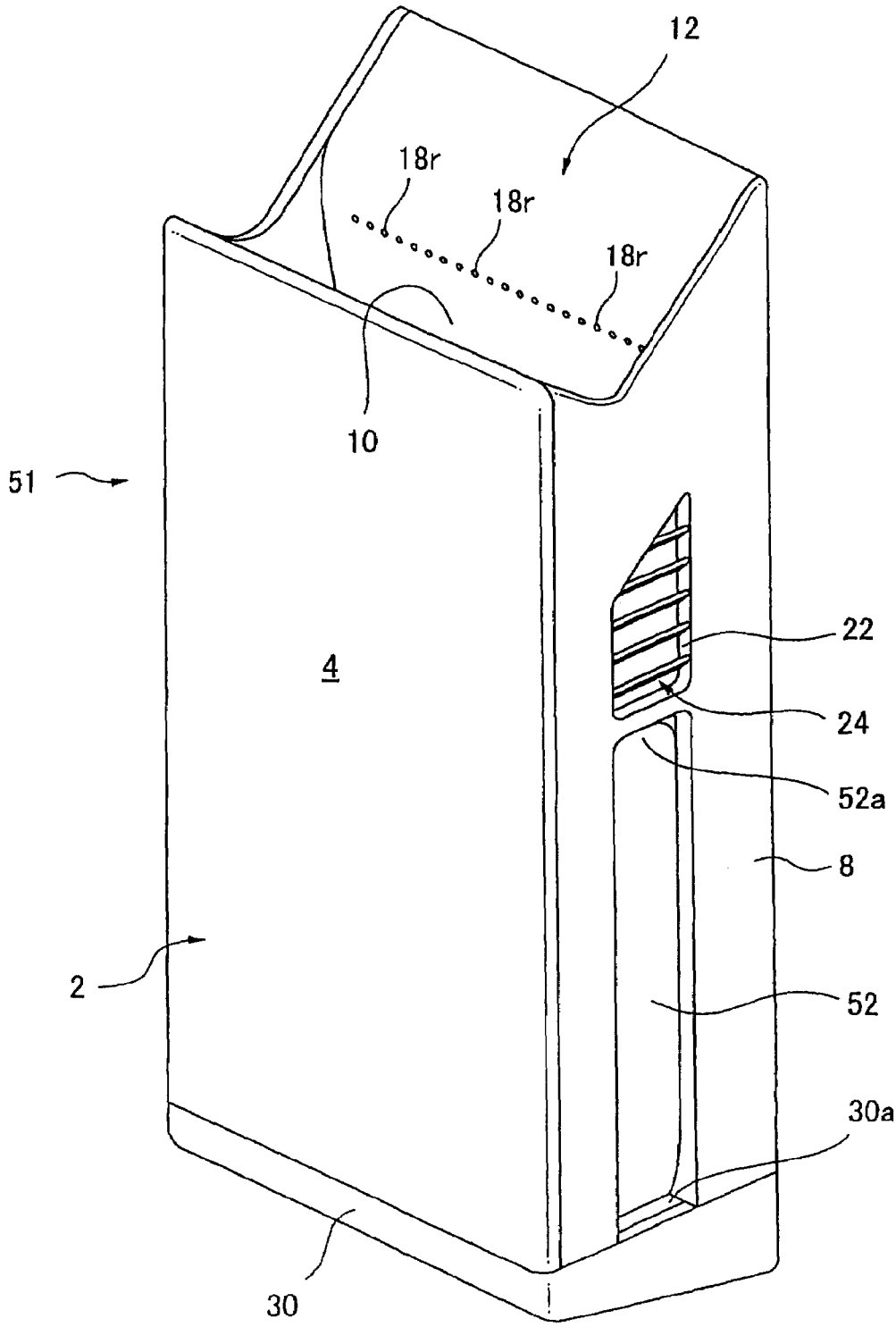
FIG. 15 is a perspective view depicting a hand dryer according to a second embodiment of the present invention.

Next, referring to FIG. 15, we will explain a hand dryer according to a second embodiment of the present invention. FIG. 15 is a perspective view depicting a hand dryer according to a second embodiment of the present invention. We will explain only those parts of the second embodiment which differ from the first embodiment described above.

As shown in FIG. 15, a hand dryer 51 has no side covers 20 as are found in the first embodiment; ventilation opening portions 22 and louvers 24 (plate-shaped members 26) are provided on the upper portion of the main housing 2 side members 8. Furthermore, a drain channel 52 matching the width dimension of the hand drying chamber 10 bottom surface portion 14 is formed at the bottom of the side members 8; this drain channel 52 forms a drain path 28, exposed to the outside. A notched portion 52*a* is formed in the top edge portion of the drain channel 52, and the drain path 28 is connected via the notched portion 52*a* to a right edge portion 14*a* formed with a curved surface R in the bottom surface portion 14 of the hand drying chamber 10. The drain channel 52 is formed so as to face the recovery container 30 recovery openings 30*a*. Thus in the hand dryer 1 according to the second embodiment, the drain path 28 is formed by the side member 8 itself, and is exposed to the outside. Note that the left side (not shown) of the main housing 2 also has the same structure.

In the second embodiment hand dryer 51, water droplets blown from the hand in the hand drying chamber 10 and falling on the bottom surface portion 14 flow down via the drain opening 28*a* over the drain path 28, and enter the recovery container 30 from the recovery openings 30*a*.

As a result, according to the hand dryer 51 of the second embodiment, the drain path 28 is exposed to the outside, making it possible to quickly discover dirt and eliminating the need for the side covers 20 which require detachment, and facilitating cleaning.

Figure 16:
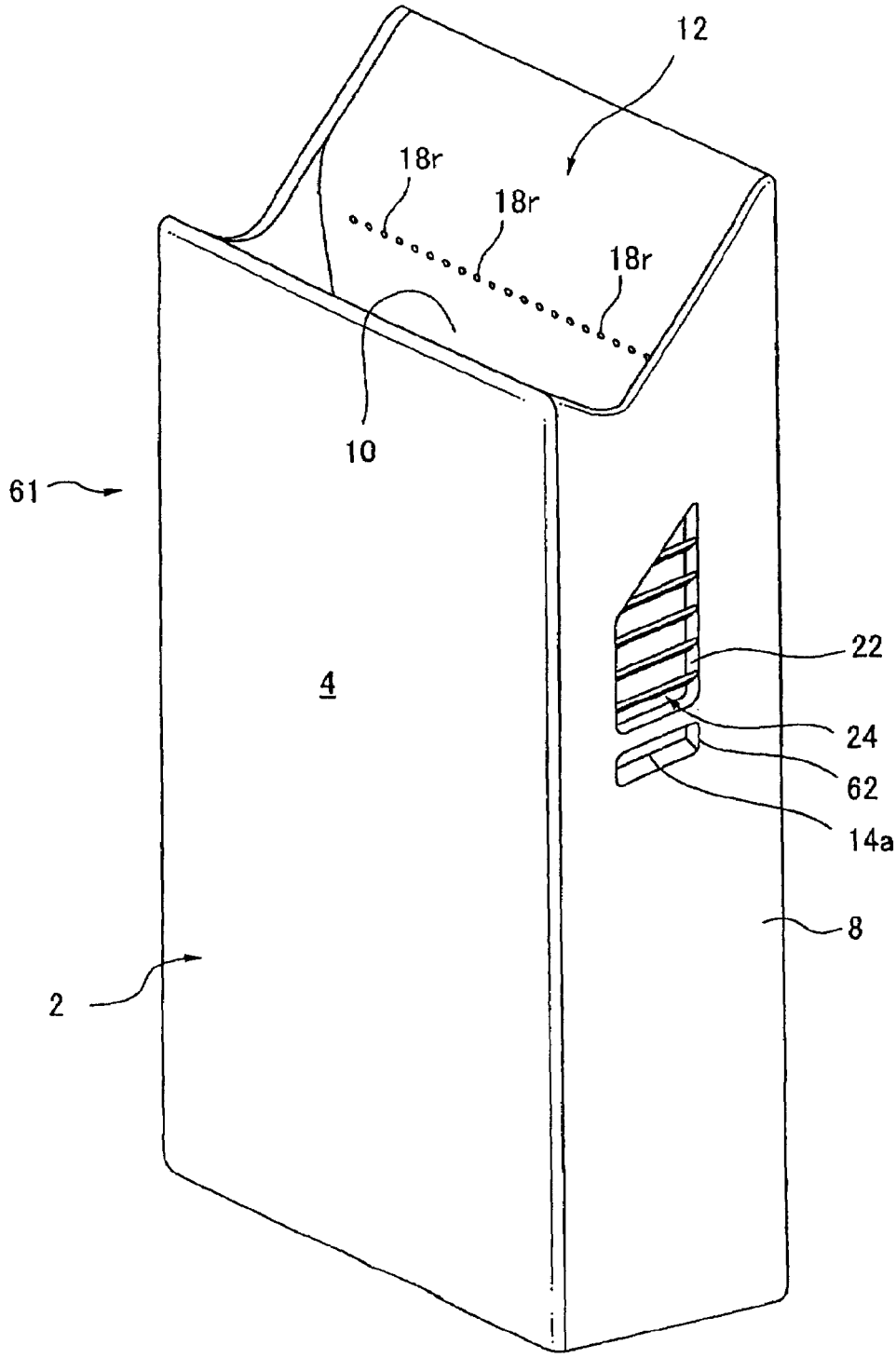
FIG. 16 is a perspective view depicting a hand dryer according to a third embodiment of the present invention.

Next, referring to FIG. 16, we will explain a hand dryer according to a third embodiment of the invention. FIG. 16 is a perspective view depicting a hand dryer according to a third embodiment of the present invention. We will explain only those parts of the third embodiment which differ from the first embodiment described above.

As shown in FIG. 16, a hand dryer 61 has no side covers 20 such as are found in the first embodiment; ventilation opening portions 22 and louvers 24 (plate-shaped members 26) are provided on the upper portion of the main housing 2 side members 8. Furthermore, a slit-shaped drain opening 62 matching the width dimension of the hand drying chamber 10 bottom surface portion 14 is formed at the bottom of the ventilation opening portions 22 of the side members 8. The bottom side of the drain opening 62 and the right edge channel portion 14*a* formed by the curved surface of the hand drying chamber 10 bottom surface portion 14 are connected. As a result, in the third embodiment water droplets within the hand drying chamber 10 flow downward from the drain opening 62 over the main housing 2 side members 8. Thus in the third embodiment the outside surface of the side members 8 becomes the drain path 28, and this drain path 28 is exposed to the outside. Note that the left side (not shown) of the main housing 2 has the same structure.

In a hand dryer 61 according to the third embodiment thus constituted the drain path 28, which includes the drain opening 62, is exposed to the outside, therefore not only can dirt be discovered immediately, but a simple design is also achieved due to the fact that no channels or the like are formed in the outside surface of the side members 8.

Figure 17:
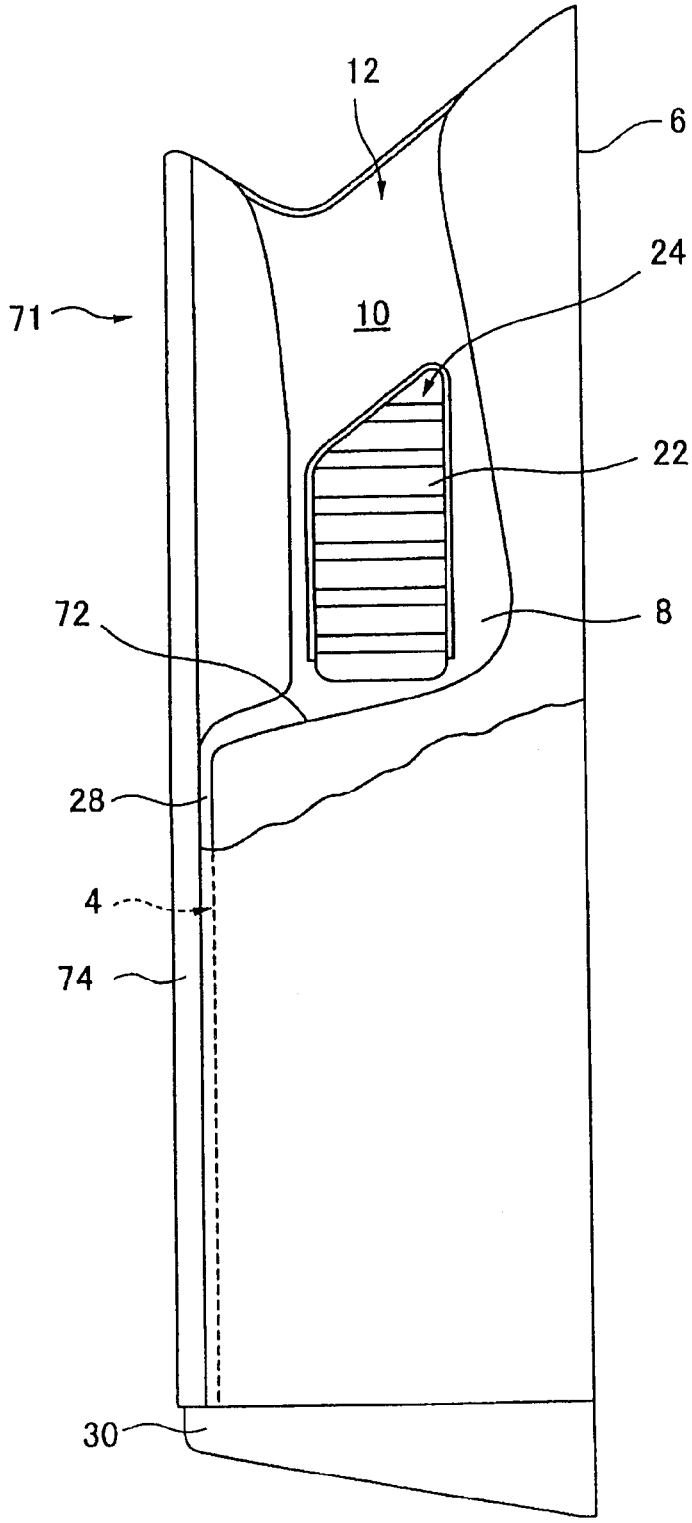
FIG. 17 is a partial sectional view depicting a hand dryer according to a fourth embodiment of the present invention.

Next, referring to FIG. 17, we will explain a hand dryer according to a fourth embodiment of the invention. FIG. 17 is a partial broken-out section depicting a hand dryer according to a fourth embodiment of the present invention. We will explain only those parts of the fourth embodiment which differ from the first embodiment described above.

As shown in FIG. 17, in the case in which there are no side covers 20 provided on the hand dryer 71, ventilation opening portions 22 and louvers 24 (plate-shaped members 26) are formed on the main housing 2 side members 8. When side covers 20 are provided, ventilation opening portions 22 and louvers 24 (plate-shaped members 26) are formed on the side covers 20. Note that in the fourth embodiment, no drain path 28 is formed on either the side members 8 or the side covers 20.

Next, in the hand dryer 71, the hand drying chamber 10 bottom portion 72 is formed as an inclined surface having a downward slope toward the front side. The main housing 2 front member 4 has a channel shape, and a front cover 74 is removably attached to the front member 4. In the fourth embodiment, a drain path 28 is formed by the outside surface of the front member 4 and the inside surface of the front cover 74. Here the upper edge portion of the drain path 28 is connected to the front edge part in which the curved surface in the bottom portion 72 is formed. The bottom end portion communicates with the recovery container 30.

In a hand dryer 71 thus constituted, water droplets blown from the hands in the hand drying chamber 10 and falling to the bottom portion 72 move toward the front edge direction (front side) along that downward slope, then flow down into the drain path 28 and are recovered in the recovery container 30.

In general, cleaning of both sides of the hand dryer becomes difficult when wash basins or the like are disposed on both sides of a hand dryer, but in a hand dryer 71 according to the fourth embodiment, the cleaning operation is extremely easy, as the drain path 28 is positioned on the front thereof. In particular, in the hand dryer 71 the drain path 28 is disposed on the front part of the main housing, and if the front cover 74 which covers the front of the main housing 2 is removed, the drain path 28 is exposed, making the cleaning operation extremely easy.

In the hand dryer 71 of the fourth embodiment, the drain path 28 has a channeled shape, preferably provided as a single drain path vertically disposed from the vicinity of the center of the bottom portion 72, but it is not limited thereto, and multiple drain paths may also be provided. The drain path may also be provided in a wide form over the entirety of the front part of the main housing 2, rather than as a channeled shape.

Figure 18:
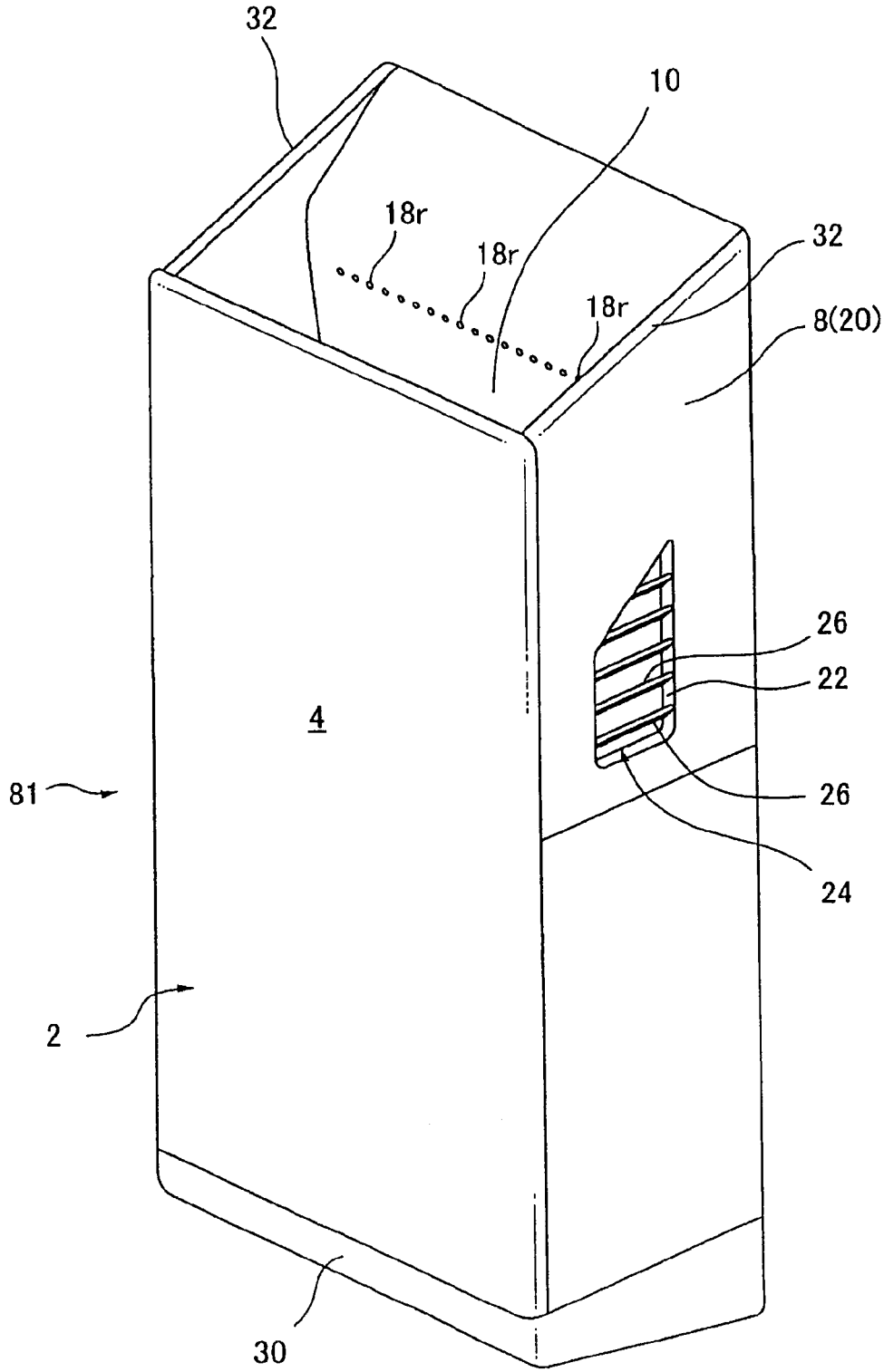
FIG. 18 is a perspective view depicting a hand dryer according to a fifth embodiment of the present invention.

Next, referring to FIG. 18, we will explain a hand dryer according to a fifth embodiment of the present invention. FIG. 18 is a perspective view depicting a hand dryer according to a fifth embodiment of the present invention. The above-described first through third embodiments formed a downward curving arc-shaped portion 32 on either the side members 8 or the upper edge portion of the side covers 20, but in the hand dryer 81 of the fifth embodiment, as shown in FIG. 18, the upper edge portion 82 of the side members 8 formed in the ventilation opening portions 22 or the like of the main housing 2 may also be formed so as to extend in a straight diagonal line. By so doing, an even more satisfactory water droplet splatter prevention effect can be obtained. Note that when ventilation opening portions 22 or the like are formed in the side covers 20, the upper edge portions of the side covers 20 are formed so as to extend in a straight diagonal line.

Figure 19:
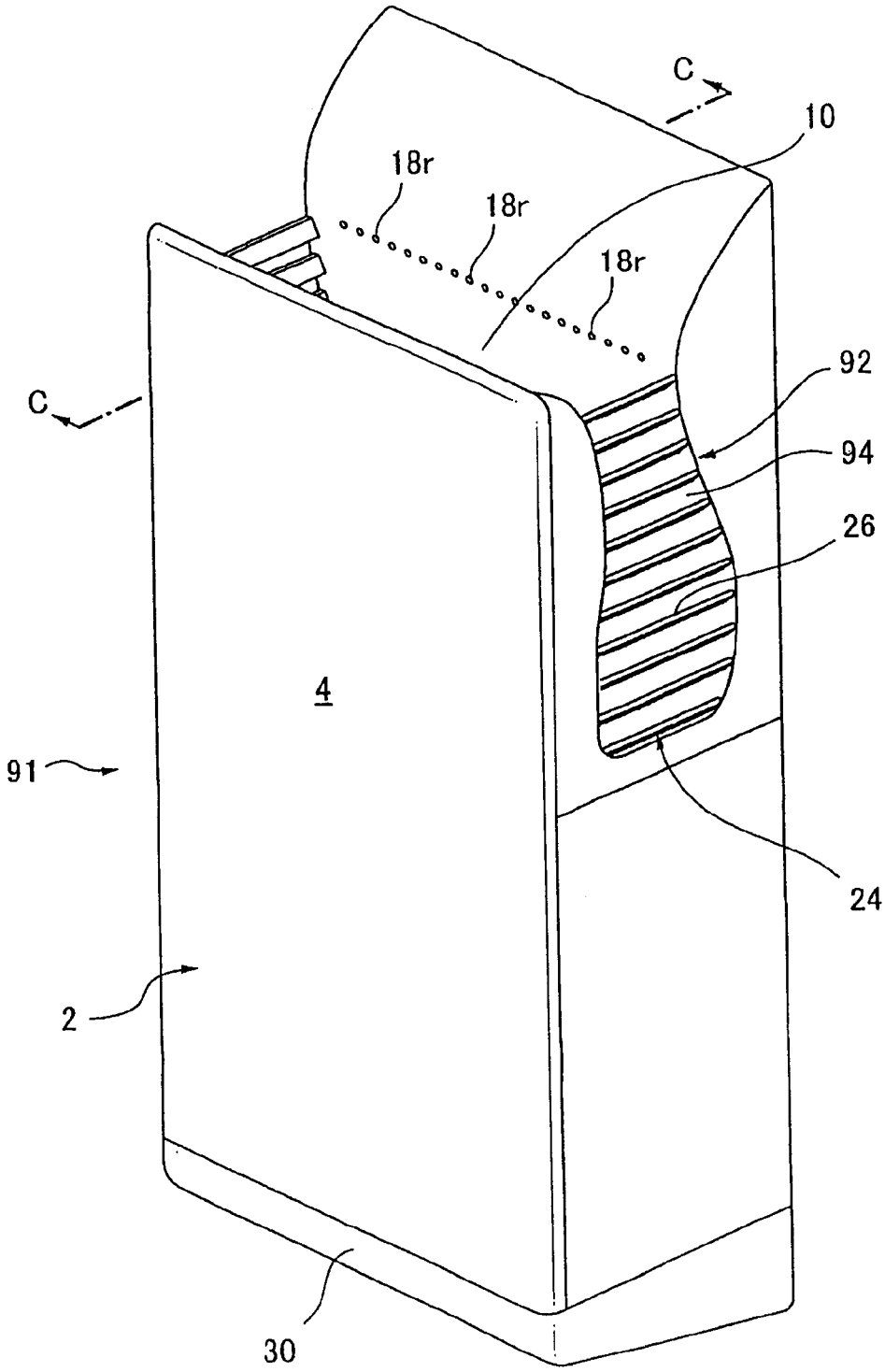
FIG. 19 is a perspective view depicting a hand dryer according to a sixth embodiment of the present invention.
Figure 20:
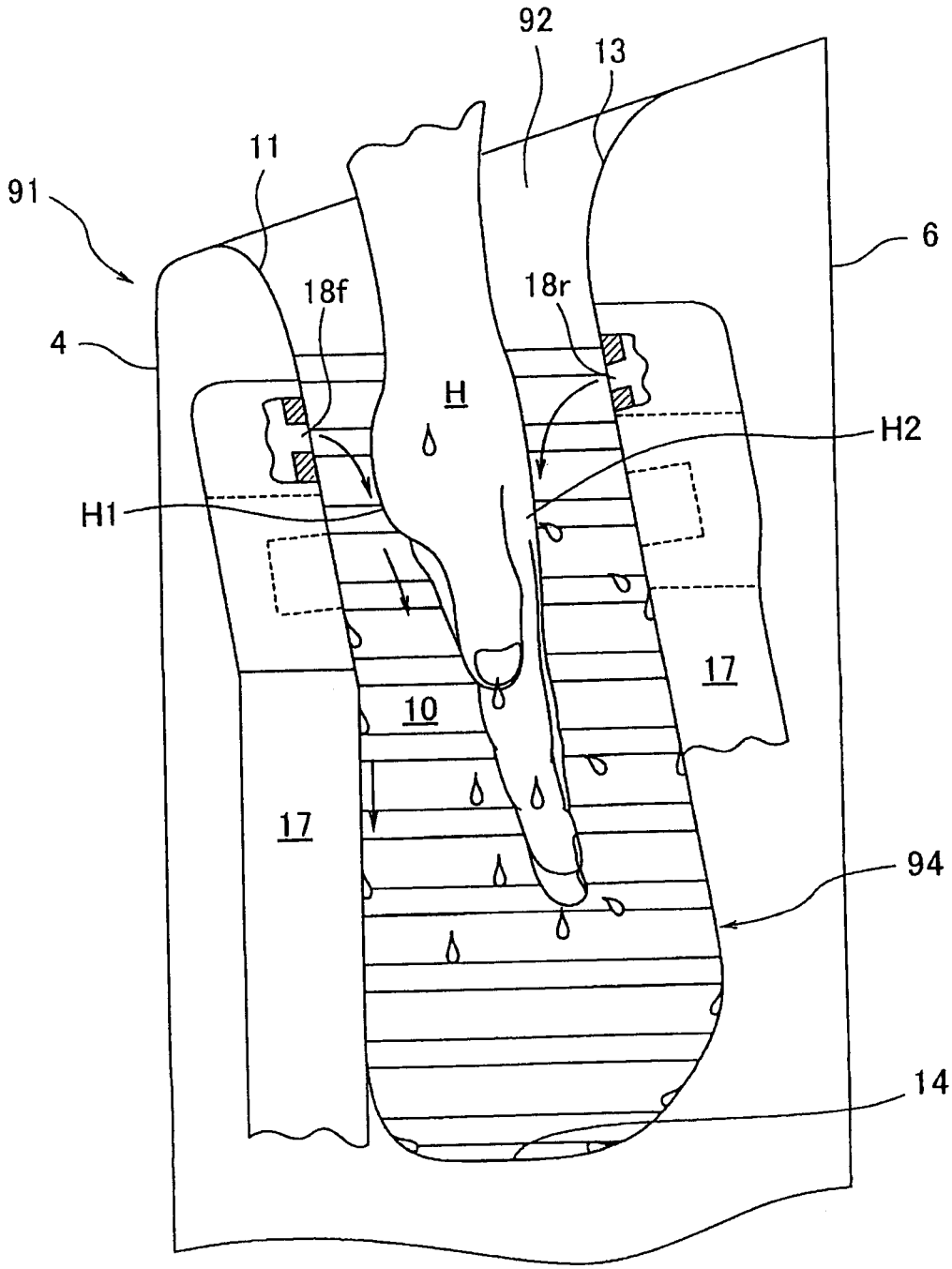
FIG. 20 is a partial sectional view depicting the hands-inserted state as seen along line C-C in FIG. 19.

Next, referring to FIGS. 19 and 20, we will explain a hand dryer according to a sixth embodiment of the present invention. FIG. 19 is a perspective view depicting a hand dryer according to a sixth embodiment; FIG. 20 is a partial sectional view depicting the hands-inserted state as seen along line C-C in FIG. 19.

As shown in FIGS. 19 and 20, in the hand dryer 91 of the sixth embodiment, the shape of a ventilation opening portion 94 formed on a side cover is set to have essentially the same shape and surface area as the sectional shape viewed from the side of the hand drying chamber 10; therefore the upper portion of the ventilation opening portion 94 has an open shape.

In the hand dryer 91 according to a sixth embodiment of the present invention, because the shape of the ventilation opening portion 94 has essentially the same shape and surface area as the sectional shape viewed from the side of the hand drying chamber 10, the air flow blown from the nozzles 18 inside the hand drying chamber 10 can be quickly exhausted out of the main housing 2, thereby enhancing drying performance.

INDUSTRIAL APPLICATIONS

The hand dryer of the present invention can be installed and widely used in restrooms or washrooms in public facilities such as train stations, hotels, theaters or large commercial facilities.

What is claimed is:

1. A hand dryer for drying a users hands by blowing air thereon, said hand dryer comprising:

a box-shaped main housing including a front member, a back member, side members, and a hand drying chamber with a hand insertion opening portion opening on the top surface thereof, said hand drying chamber being formed by a front side wall portion, a rear side wall portion, and a bottom portion;

an electric blower contained within the main housing;

a nozzle device disposed on the front side wall portion and the rear side wall portion of the hand drying chamber for blowing an air flow carried from the electric blower toward hands inserted into the hand drying chamber;

a ventilation opening portion, formed in the side of the main housing, for ventilating the air flow within the hand drying chamber to the outside of the hand drying chamber therethrough; and a water droplet splatter prevention device disposed on the ventilation opening portion in the side of the main housing for preventing the splattering to the outside of water droplets in the hand drying chamber, said water droplet splatter prevention device including a plurality of transversely orientated plate-shaped members vertically spaced apart at predetermined intervals spanning across the ventilation opening portion so as to allow air to pass therebetween, the plate-shaped members having rising slopes from the inside toward the outside of the ventilation opening portion to inhibit water droplets from exiting the hand dryer.

2. The hand dryer according to claim 1, wherein said ventilation opening portion and water droplet splatter prevention device are formed on a side cover which is removably attached to the side member of said main housing, and a ventilation internal opening portion is formed on the side member of said main housing at a position corresponding to the ventilation opening portion.

3. The hand dryer according to claim 1, wherein said water droplet splatter prevention device is furnished with a rib formed on at least the top edge portion of said ventilation opening portion so as to protrude toward the interior of said hand drying chamber.

4. The hand dryer according to claim 1, wherein said plate-shaped members are arrayed so as to form a falling slope toward the front side or the rear side of said hand dryer.

5. The hand dryer according to claim 3, wherein said rib is arrayed so as to form a falling slope toward the front side or the rear side of said hand dryer.

6. The hand dryer according to claim 2, wherein said ventilation opening portion is formed in a part of said side member which is positioned close to and above the bottom portion of said hand drying chamber.

7. The hand dryer according to claim 2, wherein said ventilation opening portion is formed in a part of said side cover which is positioned close to and above the bottom portion of said hand drying chamber.

8. The hand dryer according to claim 6, wherein said ventilation opening portion is formed to have a shape essentially the same as the sectional shape of said hand drying chamber as seen from the side.

9. The hand dryer according to claim 1, wherein a downward curving arc-shaped portion is formed on the upper edge portion of the side member of said main housing.

10. The hand dryer according to claim 2, wherein a downward curving arc-shaped portion is formed on the upper edge portion of said side cover.

11. The hand dryer according to claim 2, wherein said hand dryer further comprises a drain path formed on the outer side of said main housing side member such that water droplets in said hand drying chamber drain downward from at least one edge of the bottom portion of said hand drying chamber.

12. The hand dryer according to claim 2, wherein said hand dryer further comprises a drain path formed by the outer side of the side member of said main housing and the inner side of said side cover so as to drain water droplets in said hand drying chamber downward from at least one edge of the bottom portion of said hand drying chamber.

13. The hand dryer according to claim 1, wherein said hand dryer further comprises a front cover removably attached to the front member of said main housing, and a drain path formed by the outer side of the front member of said main housing and the inner side of said front cover so that water droplets in said hand drying chamber drain downward from the front edge of the bottom portion of said hand drying chamber.

14. The hand dryer according to claim 11, wherein the bottom portion of said hand drying chamber has an inclined surface formed as a falling slope from the center portion thereof toward both edges.

15. The hand dryer according to claim 11, wherein the bottom portion of said hand drying chamber has an inclined surface formed as a falling slope from one edge toward the other edge.

16. The hand dryer according to claim 11, wherein said hand dryer further comprises a water receiving portion, provided at the bottom end of said water drain path, for recovering water droplets flowing down said water drain path, and the bottom end of said water drain path is formed so as to protrude into said main housing at a gentle inclination with respect thereto.

* * * * *